US008317448B2

(12) United States Patent
Hankins et al.

(10) Patent No.: US 8,317,448 B2
(45) Date of Patent: Nov. 27, 2012

(54) PIPE STAND TRANSFER SYSTEMS AND METHODS

(75) Inventors: John Benjamin Hankins, Cleveland, TX (US); Brian Daniel Winter, Houston, TX (US); Gregory Christopher Grosz, Katy, TX (US)

(73) Assignee: National Oilwell Varco, L.P., Houston, TX (US)

( * ) Notice: Subject to any disclaimer, the term of this patent is extended or adjusted under 35 U.S.C. 154(b) by 440 days.

(21) Appl. No.: 12/475,808

(22) Filed: Jun. 1, 2009

(65) Prior Publication Data

US 2010/0303586 A1 Dec. 2, 2010

(51) Int. Cl.
*E21B 19/14* (2006.01)
*E21B 19/00* (2006.01)
*E21B 19/15* (2006.01)

(52) U.S. Cl. ..... 414/22.68; 414/22.63

(58) Field of Classification Search ..... 104/251, 104/98; 211/70.4; 294/102.2, 194, 196, 294/198, 206; 414/22.51–22.59, 22.61, 22.69, 414/22.71, 23, 450, 621, 739, 741, 745.4, 414/745.5, 745.6, 753.1; 901/31, 36, 37, 901/39

See application file for complete search history.

(56) References Cited

U.S. PATENT DOCUMENTS 1,211,999 A * 1/1917 Arey et al. ..... 294/91
2,848,069 A * 8/1958 Sanders ..... 187/360
3,368,699 A 2/1968 Scaggs
3,615,027 A * 10/1971 Ham ..... 414/22.71
3,658,138 A 4/1972 Gosselin
3,696,944 A * 10/1972 Campbell ..... 414/22.63
3,875,983 A * 4/1975 Kurelek ..... 144/34.1
4,013,178 A 3/1977 Brown et al.
4,042,123 A 8/1977 Sheldon et al.
4,044,895 A 8/1977 Adair
4,069,879 A 1/1978 Brown et al.
4,128,135 A 12/1978 Mitchhart et al.
4,269,554 A 5/1981 Jackson
4,274,778 A 6/1981 Putnam et al.
4,345,864 A 8/1982 Smith, Jr. et al.
4,462,733 A 7/1984 Langowski et al.
4,647,100 A * 3/1987 Lessway ..... 294/119.1
4,674,948 A * 6/1987 Hornacek ..... 414/744.8
4,708,411 A * 11/1987 Peterman ..... 312/201
4,715,761 A 12/1987 Berry et al.
4,725,179 A 2/1988 Woolslayer et al.
4,738,321 A 4/1988 Olivier
4,744,710 A 5/1988 Reed
4,765,401 A 8/1988 Boyadjieff
4,850,439 A 7/1989 Lund
4,854,397 A 8/1989 Warren et al.
4,862,973 A 9/1989 Voigts et al.
4,995,465 A 2/1991 Beck et al.

(Continued)

OTHER PUBLICATIONS

International Search Report and Written Opinion, ISA/KR, Korean Intellectual Property Office, Chung, Sang IK (Authorized Officer), Jan. 4, 2011, Application No. PCT/US2010/035581 (8 pp).

*Primary Examiner* — Gregory Adams
(74) *Attorney, Agent, or Firm* — Conley Rose, P.C.

(57) ABSTRACT

Methods and systems for transferring pipe (including tubulars such as casing, tubing, drill pipe, etc.) or stands of pipe from one location to another in a wellbore derrick, e.g. from a fingerboard to a well center.

16 Claims, 22 Drawing Sheets

U.S. PATENT DOCUMENTS 5,244,329 A 9/1993 McGill et al.
5,451,129 A 9/1995 Boyadjieff et al.
5,465,799 A 11/1995 Ho
5,711,382 A 1/1998 Hansen et al.
5,988,299 A 11/1999 Hansen et al.
6,003,400 A * 12/1999 Rauchfuss ..... 74/490.06
6,050,348 A 4/2000 Richarson et al.
6,412,576 B1 7/2002 Meiners
6,527,493 B1 3/2003 Kamphorst et al.
6,609,573 B1 8/2003 Day
6,705,414 B2 3/2004 Simpson et al.
6,779,614 B2 8/2004 Oser
6,802,378 B2 10/2004 Haci et al.
6,821,071 B2 11/2004 Woolslayer et al.
6,854,520 B1 2/2005 Robichaux
6,857,483 B1 2/2005 Dirks et al.
6,860,694 B2 3/2005 Slettedal
6,918,453 B2 7/2005 Haci et al.
6,944,547 B2 9/2005 Womer et al.
6,976,540 B2 12/2005 Berry
6,997,265 B2 2/2006 Berry
7,083,007 B2 8/2006 Herst
7,137,454 B2 11/2006 Pietras
7,140,443 B2 11/2006 Beierbach et al.
7,140,453 B2 11/2006 Ayling
7,178,612 B2 2/2007 Belik
7,249,639 B2 7/2007 Belik
7,293,607 B2 11/2007 Lambert et al.
7,503,394 B2 3/2009 Bouligny
7,510,028 B2 3/2009 Welsh
7,540,338 B2 6/2009 Belik
2005/0126827 A1 6/2005 Berry
2006/0081379 A1 4/2006 Fehres et al.
2008/0174131 A1 * 7/2008 Bouligny et al. ..... 294/88

* cited by examiner

PIPE STAND TRANSFER SYSTEMS AND METHODS

BACKGROUND OF THE INVENTION

1. Field of the Invention

The present invention is directed to systems for moving tubulars and pipe stands in a derrick; to systems for transferring a tubular or a stand of pipe between a fingerboard area and a well center; and to methods of the use of such systems.

2. Description of Related Art

A wide variety of drilling systems, apparatus, and methods are known, including, but not limited to, the disclosures in U.S. Pat. Nos. 6,944,547; 6,918,453; 6,802,378; 6,050,348; 5,465,799; 4,995,465; 4,854,397; 4,850,439; and 3,658,138. A wide variety of tubular handling and tubular transfer systems for wellbore operations are known; for example, and not by way of limitation, those disclosed in U.S. Pat. Nos. 7,293,607; 7,137,454; 7,083,007; 6,976,540; 6,821,071; 6,779,614; 5,988,299; 5,451,129; 4,862,973; 4,765,401; 4,725,179; 4,462,733; 4,345,864; 4,274,778; 4,269,554; 4,128,135; 4,044,895; 4,042,123; 4,013,178; and in U.S. Patent Application 2006/0081379.

In certain well drilling methods, a string of drill pipe having a drill bit mounted on the lower end thereof is suspended from a traveling block in a drilling rig mast. The drill string is suspended from the traveling block by a swivel which enables rotational force to be applied to the drill string, typically by a rotary table at the drilling rig floor, or a power swivel or top drive in the derrick to advance the depth of the drilled bore. As the depth of the bore increases, additional lengths of drill pipe are added to the drill string at the surface.

Often, for various reasons, the drill string is pulled from the bore, e.g., in order to change the drill bit or to run testing or other equipment into the bore on the end of the drill string. When pulling drill pipe from the bore, the traveling block is raised until a stand (multiple connected pieces) of pipe extends above the drilling rig floor. In certain cases, a stand comprises two or three pieces of pipe, e.g. three pieces totaling approximately 90 feet in length. Next, slips are placed between the pipe and the drilling rig floor in order to suspend the drill string in the well bore from a point beneath the pipe stand which extends above the drilling rig floor. The connection between the pipe stand and the remainder of the drill string is unthreaded and the lower end of the stand is placed on a support pad, sometimes referred to as a setback, on the drilling rig floor. Next, a man positioned in the upper portion of the rig disconnects the upper end of the stand from the traveling block and places the upper end of the stand between a set of racking fingers on a fingerboard which support the stand in a substantially vertical position. The traveling block is then lowered to pick up the drill string and the process is repeated until all of the pipe, e.g. in three piece stands, is supported at the lower ends thereof on the setback with the upper ends being constrained between pairs of racking fingers on the fingerboard. When running a new drill bit or a tool into the well bore, this process is reversed. This process is repeated until the drill string is removed or, in the reverse process, when the drill bit reaches a desired depth in the well bore.

A variety of difficulties and dangers can be associated with procedures for running a drill string into or out of a well bore to personnel involved in these procedures, e.g., personnel working on a platform above a drilling rig floor. This job can entail reaching from the platform to the center line of the well in order to connect the upper end of a pipe stand to the traveling block (and to disconnect the same therefrom) and can require moving the upper end of each pipe stand between the racking fingers and the center line of the well.

Various efforts have been made to automate one aspect or another of the procedure for running drill pipe into and out of the well bore. Some of these procedures incorporate the use of mechanical arms mounted on the drilling rig mast adjacent the racking fingers for moving the upper ends of the pipe stands between the well center line and the racking fingers. Some include lower arms or dollies for simultaneously gripping the lower end of the stand in order to move it between the well center line and the setback. Some of the known devices move the stands in response to control signals generated by a computer. Several of the known devices are cumbersome in their design and, thus, in their operation and are expensive to build. Some known apparatus have a single arm for manipulating pipe at the upper end of a pipe stand.

U.S. Pat. No. 4,725,179 describes an automated racking apparatus for use to facilitate coupling and uncoupling substantially vertical lengths of pipe by moving the pipe between a coupled position and a racking assembly. An arm assembly includes a gripping head mounted thereon for grasping a pipe. Apparatus are provided for moving the arm assembly. The lower end of a pipe received in the racking assembly is supported by a support assembly which includes sensor apparatus the location of the lower end of each pipe on the support assembly. Control apparatus connected to the sensor apparatus and to the moving apparatus is provided for moving the arm assembly to a preselected position dependent upon the position of the lower end of a pipe which is set on or removed from the support assembly. In one aspect, the arm assembly includes a first arm and a second arm which are extendable and retractable along axes oriented at ninety degrees to one another. In one aspect, U.S. Pat. No. 4,725,179 describes an automated pipe racking apparatus for use to facilitate threading and unthreading substantially vertical lengths of pipe on a drilling rig by moving the pipe between the well bore center line and a racking assembly. An arm having a gripping head mounted thereon is extendable and retractable relative to a carriage mounted on the drilling rig working board. When storing pipe, the lower end of each pipe is set on a support assembly which includes a plurality of switches which signal the position of each pipe thereon. The arm and carriage are moved under control of a computer to an appropriate slot for storing the upper end of the pipe stand. When running pipe into the well bore, the arm and carriage move the upper end of the pipe to the center line of the well and when the traveling block of the drilling rig picks up the pipe, a signal generated by the switch beneath the pipe causes the carriage and arm to move to the location for unracking the next stand of pipe; which in one particular aspect, includes an arm assembly having a gripping head mounted thereon for grasping a pipe, apparatus for moving the arm assembly, a support assembly for supporting the lower end of a pipe received in the racking assembly, apparatus for sensing the location of the lower end of each pipe on the support assembly; and control apparatus operatively connected to the sensing apparatus and to the moving apparatus for moving the arm assembly to a preselected position dependent upon the position of the lower end of a pipe which is set on or removed from the support assembly.

U.S. Pat. No. 6,821,071 describes an automated pipe racking apparatus for a drilling rig having an elevator suspended over a well bore. An arm support member is rotatable about an axis parallel to the well bore. A gripper arm extends from the arm support member along an axis normal to the axis of rotation of the arm support member. A gripper head assembly extends from the gripper arm, the gripper head assembly having a pair of opposed, arcuate gripper fingers, each said finger rotatable by a motor. In one aspect, an automated pipe racking process is proposed for a drilling rig with an elevator suspended over a well bore, which process includes: lifting a pipe stand having at least one pipe section with the elevator; moving a lower end of the pipe stand over a base pad; setting the lower end of the pipe stand down onto a base pad; capturing the pipe stand with a gripper head assembly having a pair of rotating arcuate fingers; releasing the pipe stand from the elevator; and moving an upper end of the pipe stand with the gripper head assembly to a chosen location.

U.S. Pat. No. 7,083,007 describes a fingerboard having at least one fingerboard row for storing a plurality of threaded tubulars with a plurality of latches connected to the at least one fingerboard row for lockingly retaining at least one threaded tubular, wherein each of the plurality of latches is movable between a locked position and an unlocked position. A row controller is connected to each of the latches for individually and sequentially moving the latches between the locked and unlocked positions, wherein the row controller is manually operable from a location remote from the latches such that the latches are manually and remotely controlled. In one aspect, a fingerboard is disclosed that includes: at least one fingerboard row for storing a plurality of threaded tubulars; a plurality of latches connected to the at least one fingerboard row for lockingly retaining at least one threaded tubular, wherein each of the plurality of latches is movable between a locked position and an unlocked position; and a row controller connected to each of the latches for individually and sequentially moving the latches between the locked and unlocked positions, wherein the row controller is manually operable from a location remote from the latches such that the latches are manually and remotely controlled. In one aspect, a method of storing a plurality of threaded tubulars in a fingerboard is proposed that includes: providing a fingerboard row for storing the plurality of threaded tubulars; providing a casing having a plurality of exhaust ports, wherein each of the plurality of exhaust ports corresponds to at least one of the plurality of threaded tubulars; providing a piston having an elongated rod that is moveable relative to the casing; connecting a plurality of latches to the fingerboard row, wherein each of the plurality of latches is connected to a corresponding one of the plurality of exhaust ports and each latch is biased to a closed position and moveable between the closed position and an opened position; connecting an air source to the casing; moving the elongated rod to a fully extended position such that each exhaust port is uncovered by the elongated rod and air from the air source enters each uncovered exhaust port and forces each of the latches into a unlocked position; adding successive ones of the plurality of threaded tubulars to a position within the fingerboard row; and moving the elongated rod to one of a plurality of retracted positions to cover the corresponding exhaust port of each added threaded tubular causing each latch to be biased from the unlocked position to the locked position to lock each added threaded tubular to the fingerboard row.

U.S. Pat. No. 4,042,123 describes an hydraulically powered pipe handling system, a general purpose digital computer is used to control the operation of hydraulically powered racker arms as well as the various auxiliary functions involved in vertical pipe racking operations. The manual pipe-racking system (that is, that which is hydraulically powered and under the control of one or more operators) is retained, the computer controlled mode of operation being an alternative system present in the overall design. There is provided to the operator, while the system is in its automatic mode of operation, visual indication of length of drill string, depth of hole, depth of drill bit and composition of the drill string, including number and type of pipe lengths making up the drill string. In one aspect, a drill pipe handling system for the automated handling of drill pipe lengths, in a well being drilled or otherwise serviced, is described including: rack apparatus for receiving pipe stands and supporting the pipe stands in spaced apart vertical rows adjacent the side of a derrick, the rack apparatus including a series of parallel rows for receiving the pipe stands and fingers selectively actuable for forming rectangular openings along the parallel rows for locking the pipe stands in place; sensor apparatus for sensing the individual actuation of the fingers; racker apparatus for successively moving the drill pipe stands between a position adjacent the center of the derrick and the rack apparatus; a racker arm extending horizontally from the racker apparatus, the racker arm having a gripper at the outer end thereof for engaging the drill pipe stands; computer control apparatus for controlling the rack apparatus, the fingers, the racker apparatus, and the racker arm; the computer control apparatus including, a programmable general purpose digital computer; a computer program for providing sequential instructions to the digital computer; input-output apparatus for monitoring and controlling the digital computer; the input-output apparatus including, display apparatus for providing visual indication of the status of the computer program and for permitting data or instructions to be input to the digital computer; and a driller's console for permitting control of the drill pipe handling system by inputting instructions to the digital computer, the console including a selector for selecting automated or manual operations of the handling system, and controls and indicator apparatus for starting or stopping the automated function of the handling system and for providing visual indication of the operating status of the handling system.

Due to the narrow width of the fingers in some fingerboards, some prior known gripper heads have a narrow side or part for reaching in between a target stand and a stand in a next row, and a thick side or part which can take up the space vacated by the stand in the previous row. This arrangement requires that the head, or part of it, be reversed when going from one setback area to the other. Also, it does not reach down a row with stands on either side. Certain conventional systems have a gripping head, or gripper with two projecting parts, e.g., but not limited to, as in U.S. Pat. Nos. 4,725,179 and 4,044,985, in which one part is sized (often generally straight, usually relatively narrow) to enter between pipes or tubulars on adjacent rows of a fingerboard and a second part is sized and located to encompass a portion of a pipe or tubular to be moved. In certain aspects, the first part is relatively straight and the second part is curved. To go between pipe or tubulars on one side of the fingerboard, the first part is inserted between two pipes. For use on an opposite side of the fingerboard, the gripping head is turned over so that the first part can go between pipes in adjacent rows. This is necessary because the second curved part of the gripping head cannot fit between two adjacent pipes, each in an adjacent row.

SUMMARY OF THE INVENTION

An aspect of the invention provides systems for transferring pipe (including tubulars such as casing, tubing, drill pipe, etc.) or stands of pipe from one location to another in a wellbore derrick, e.g. from a fingerboard to a well center.

An aspect of the invention provides a pipe handler for handling pipe in a fingerboard, the fingerboard having a plurality of spaced-apart fingers for supporting a plurality of tubulars, e.g. pieces of pipe, the pipe handler including: a pipe handling head having a head width; a distance comprising a second width, the second width including the distance between two fingers of the finger board and twice the width of one finger; and the head width less than the second width to facilitate movement of the pipe handling head along a row between the two fingers.

An aspect of the invention provides a pipe handler for handling pipe in a fingerboard, the fingerboard having a plurality of spaced-apart fingers for supporting a plurality of tubulars, e.g. pieces of pipe, the pipe handler including: a pipe handling head, extension apparatus for moving the pipe handling head, carriage apparatus, the extension apparatus connected to the pipe handling head and to carriage apparatus, track structure, the carriage apparatus movable on the track structure so that the pipe handling head can access pipe on the fingerboard, at least one movable arm movable with respect to a pipe on the fingerboard to facilitate engagement of the pipe by the pipe handling head, and at least one flipper (or multiple flippers) movably connected to the at least one movable arm (or arms), the at least one flipper (or flippers) projecting inwardly of the at least one movable arm (or arms), the at least one flipper (or flippers) constantly biased inwardly to assist in maintaining pipe in position in the pipe handling head.

BRIEF DESCRIPTION OF THE DRAWINGS

A more particular description of embodiments of the invention briefly summarized above may be had by references to the embodiments which are shown in the drawings which form a part of this specification.

DETAILED DESCRIPTION

Figure 1A:
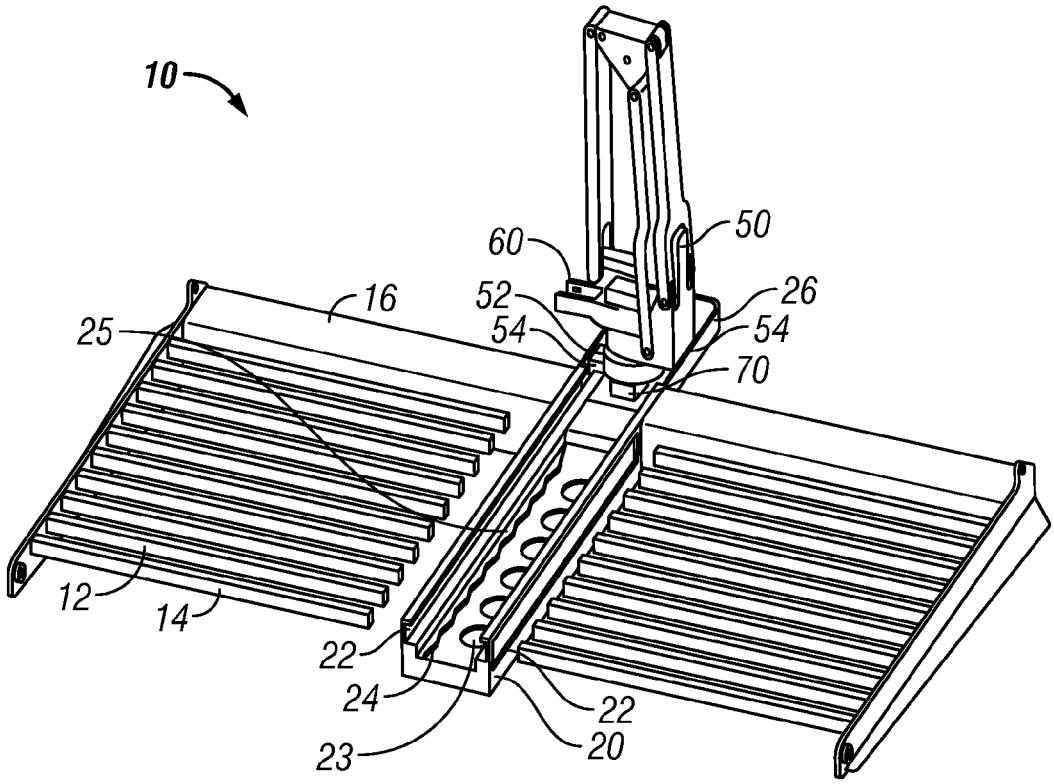
FIG. 1A is a perspective view of a pipe handling system.

Referring now to FIG. 1, a system 10 according to the present invention has a track 20 mounted between rows 12 of fingers 14 of a fingerboard 16. A pipe handler 50 according to the present invention is movably mounted on the track 20. The pipe handler 50 has a carriage 52 with rotatable rollers 54 which roll in channels 22 of the track 20.

As discussed in detail below, a selectively locking mechanism 70 of the pipe handler 50 (or mechanisms 70) engages a lock rim 24 (or rims) of the track 20. The pipe handler 50 has a pipe handling head 60.

Figure 1C:
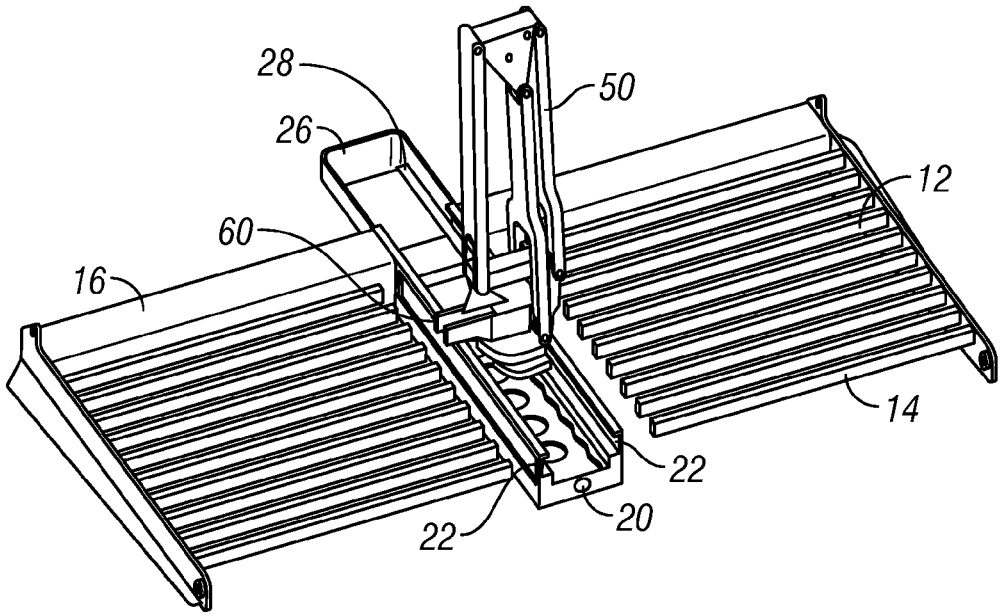
FIG. 1C is a perspective view of the system of FIG. 1A.
Figure 1B:
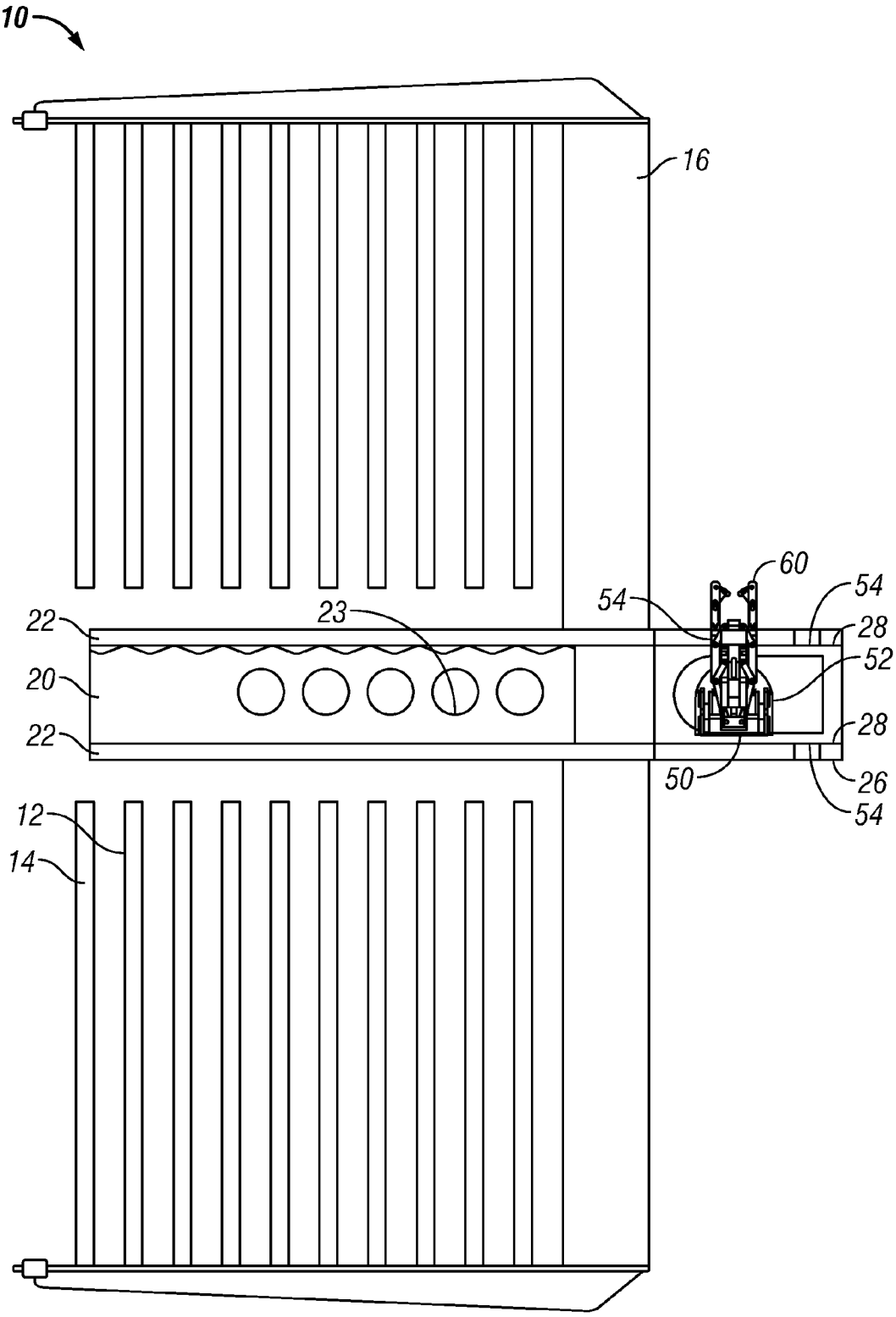
FIG. 1B is a top view of the system of FIG. 1A.
Figure 1D:
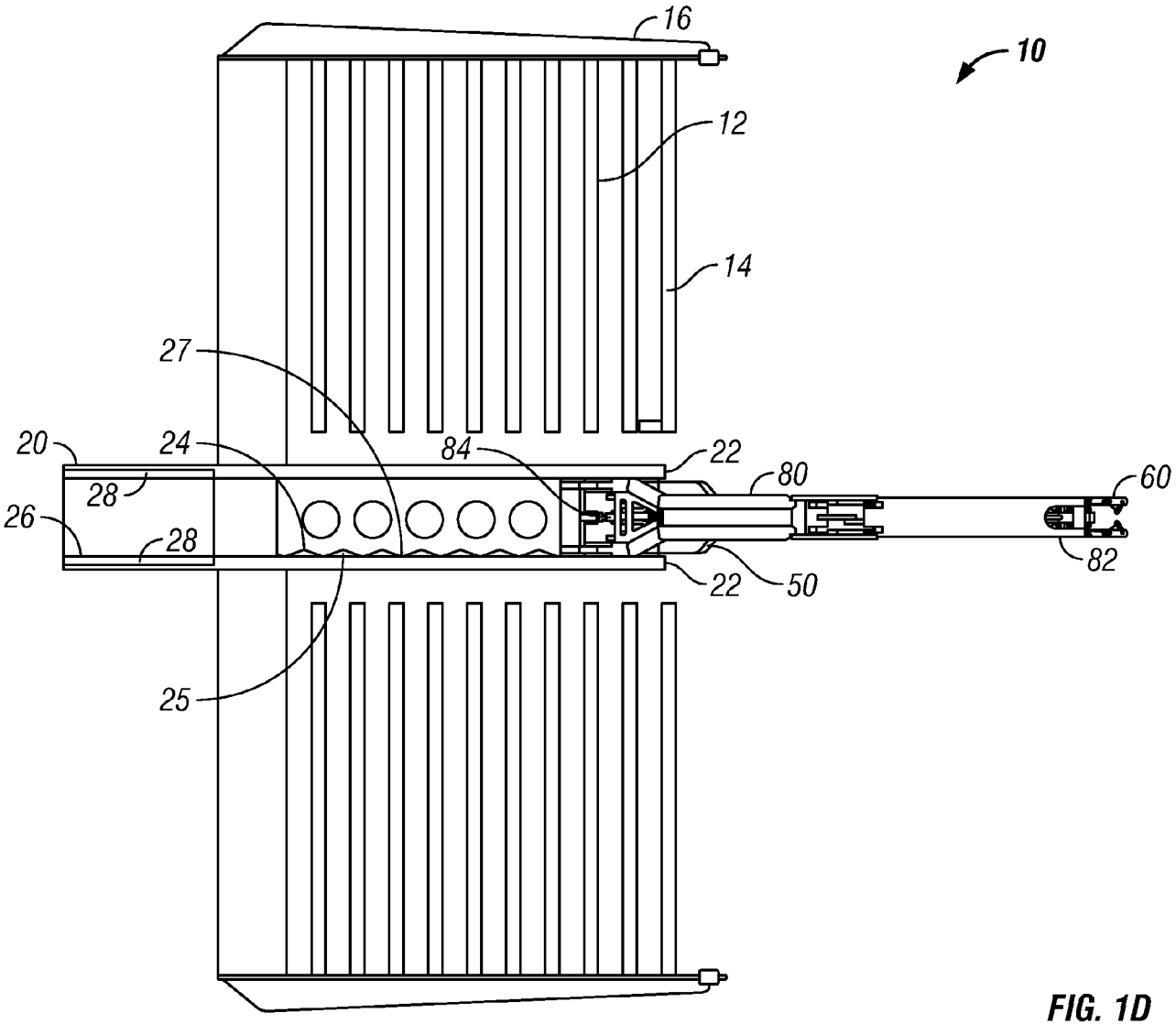
FIG. 1D is a top view of the system of FIG. 1A.
Figure 1E:
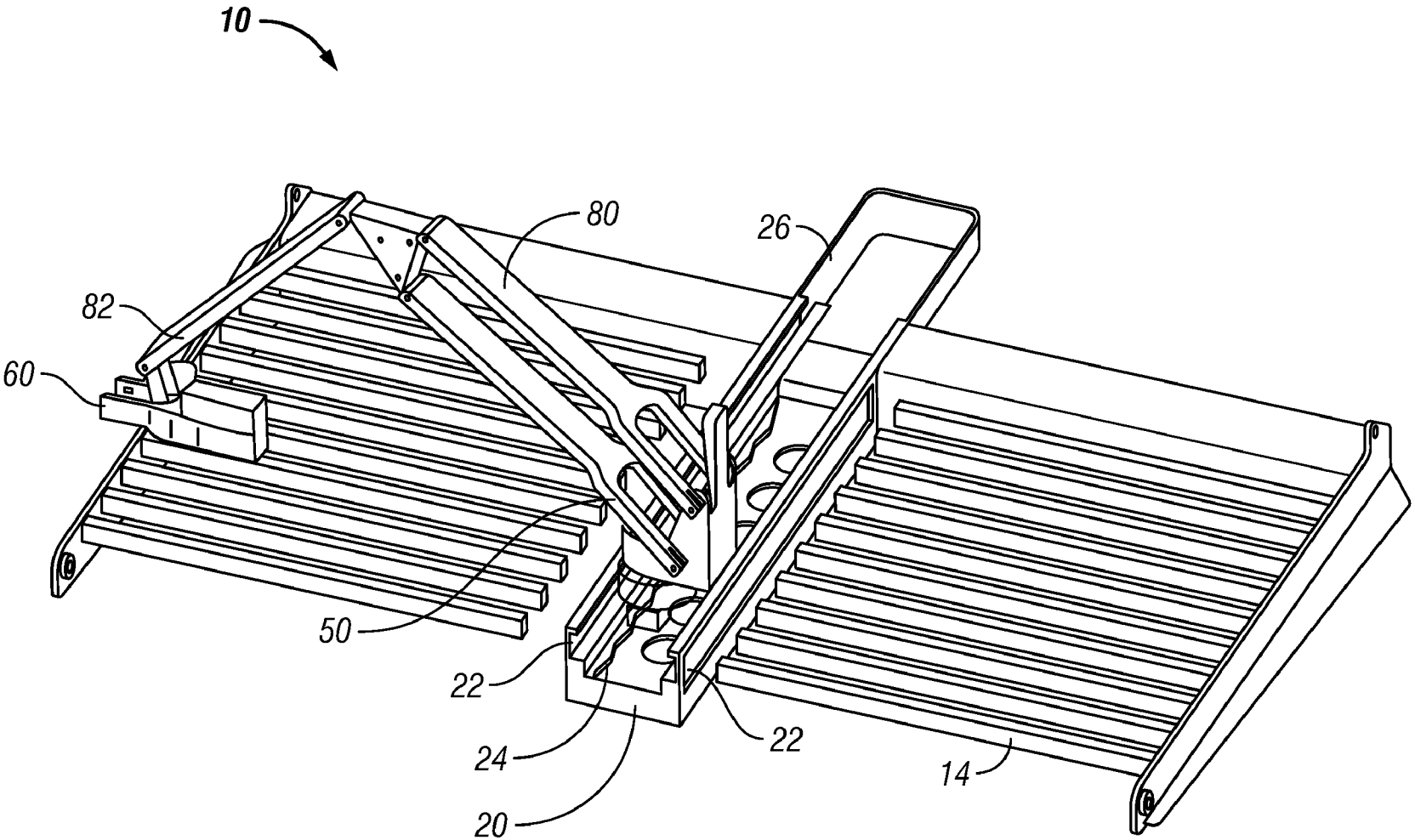
FIG. 1E is a perspective view of the system of FIG. 1A.

As shown in FIGS. 1A, 1C, and 1E, the pipe handler 50 is movable on the track 20 so that the pipe handling head 60 can access any pipe or stand of pipes supported by the fingerboard 16. As shown in FIGS. 1D, 1E, 1F, 2A, 5 and 6, the pipe handler 50 is extendable so that the pipe handling head 60 can move pipe or a stand of pipe to a desired location.

Figure 12A:
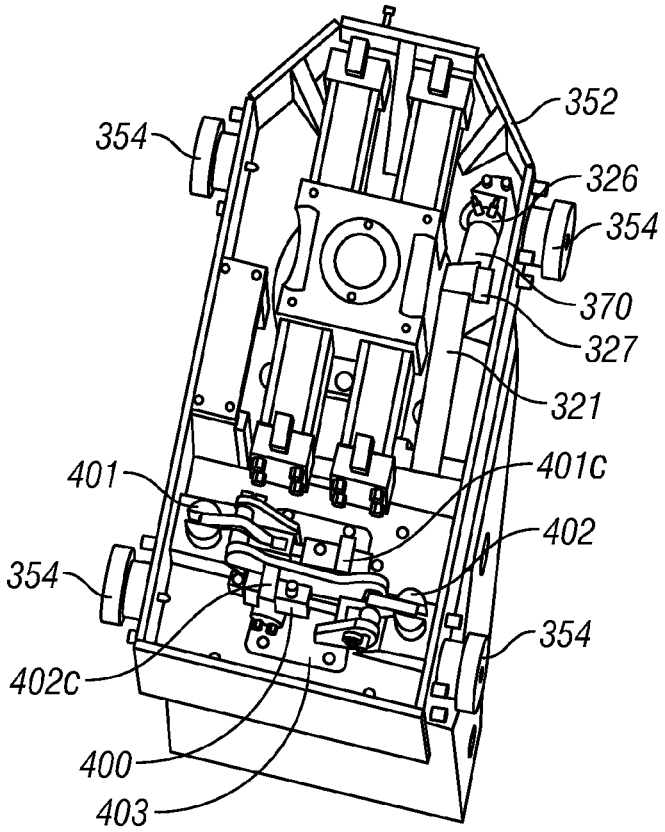
FIG. 12A is a top view of part of a carriage of the pipe handler of FIG. 11A.
Figure 12B:
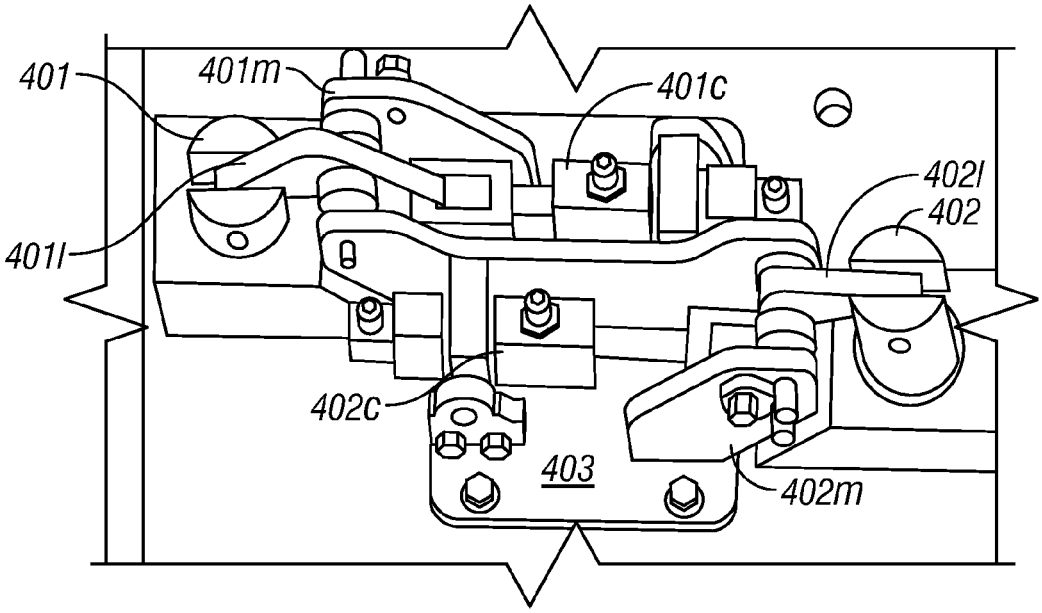
FIG. 12B is an enlarged view of part of the carriage as shown in FIG. 12A.
Figure 12C:
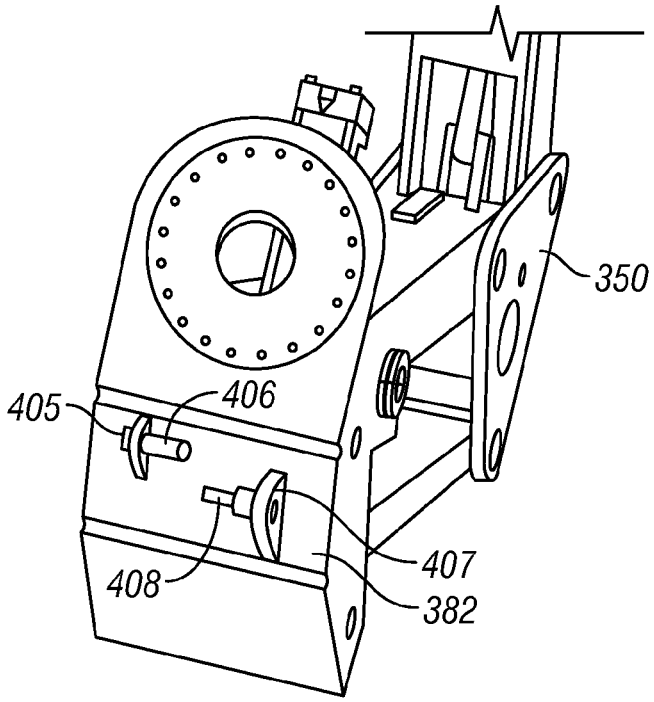
FIG. 12C is a perspective view of part of the pipe handler of FIG. 12A.
Figure 12D:
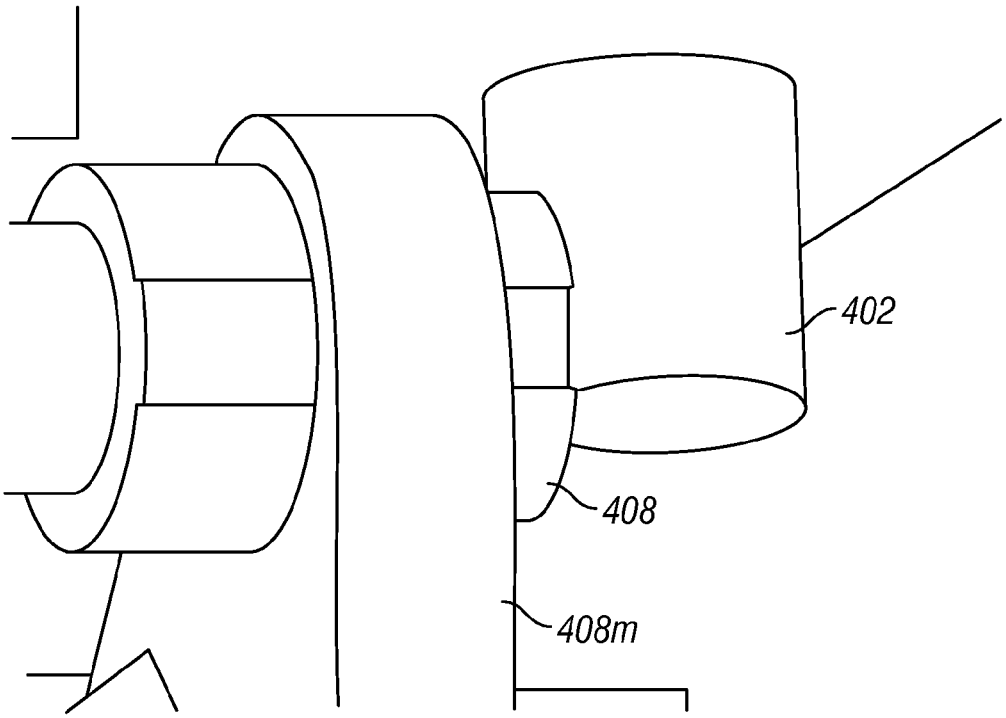
FIG. 12D is an enlarged view of part of the carriage as shown in FIG. 12C.
Figure 12E:
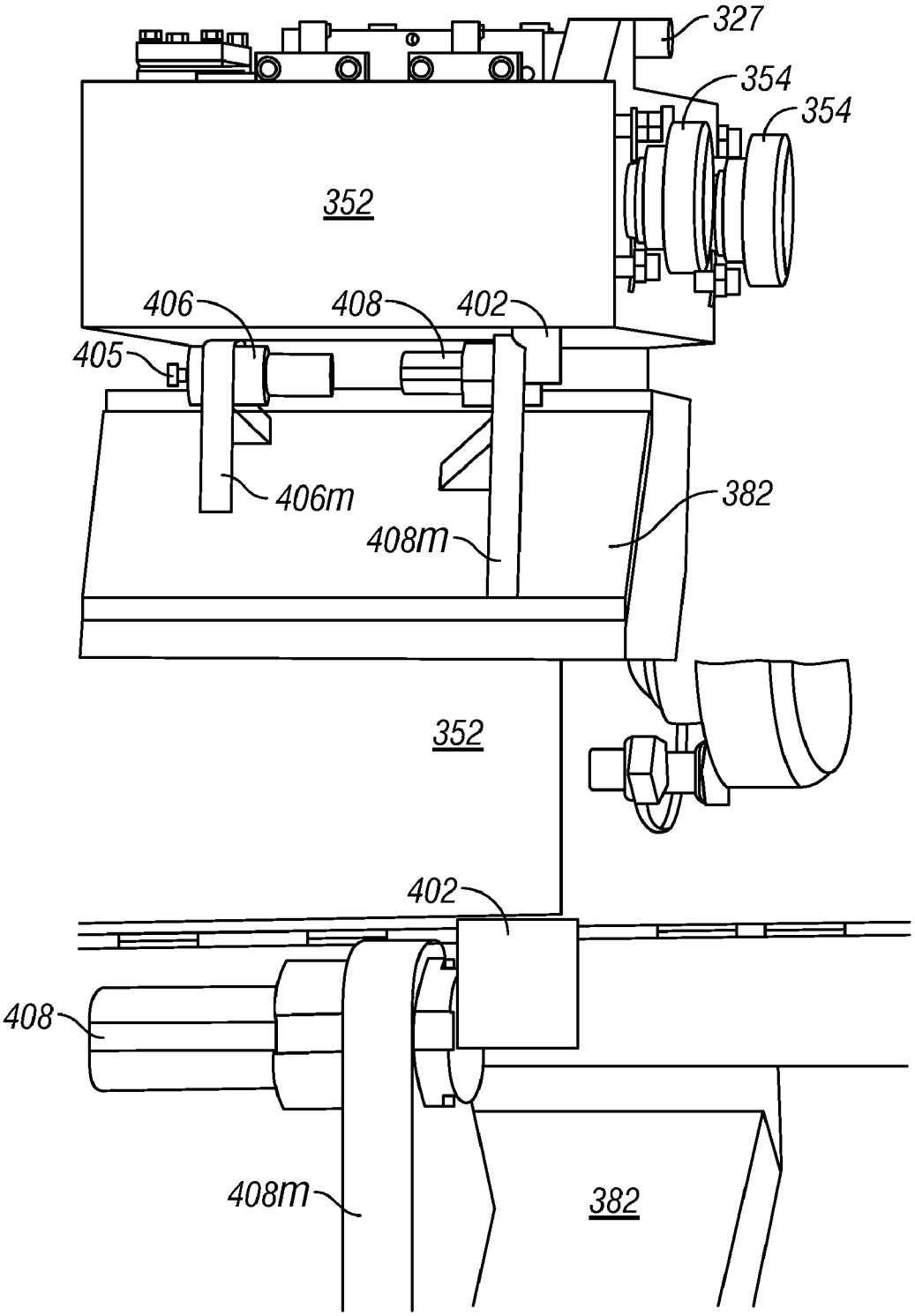
FIG. 12E is an end view of part of the carriage of the pipe handler of FIG. 12A.

As shown in FIG. 1A, the track 20 is located below a level of the fingers 14. As described below (see FIGS. 12A-12C) the pipe handler may, according to the present invention, be located below the fingerboard.

Optionally, the track 20 has a storage section 26 projecting out from the fingerboard 16. As shown e.g. in FIGS. 1A and 1B, the pipe handler 50 may be stored in the storage section 26. In one aspect, the pipe handler 50 is installed on the track 20 by lowering it over the storage section 26 and then into the storage section 26. The channels 22 do not extend into the storage section 26 and the rollers 54 rest on bottom surfaces 28 of the storage section 26.

Figure 1F:
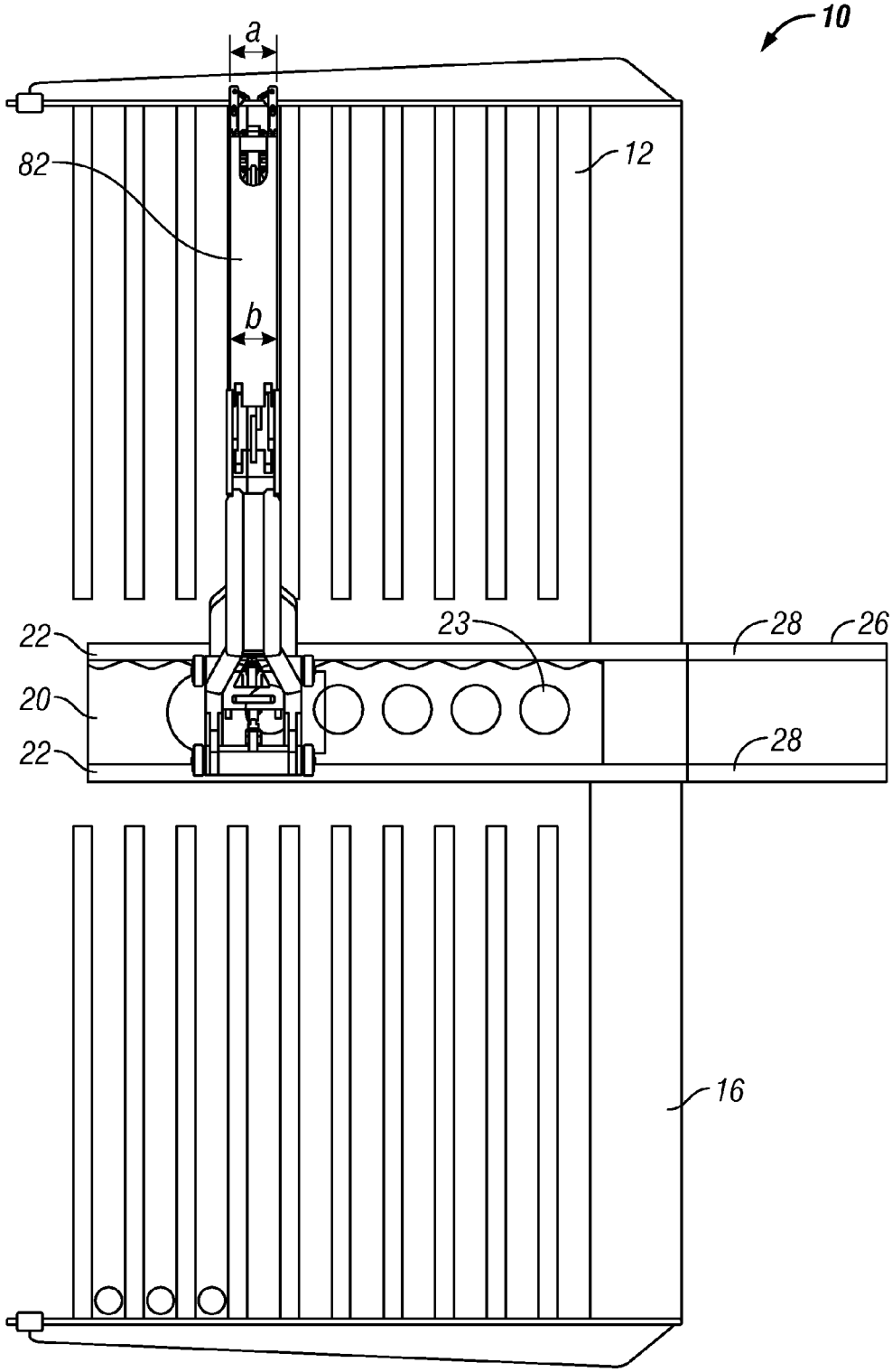
FIG. 1F is a top view of the system of FIG. 1A.

As shown in FIG. 1F, in certain particular aspects, the pipe handling head 60 has a width "a" less than a width "b" ("b" is the width between two fingers 14 plus two finger widths). In such an embodiment, the pipe handling head 60 can be moved down any row 12 of the fingerboard 16 without contacting a pipe or stand in an adjacent row.

In one aspect, the lock rim 24 has wedge members 25 which meet at points 27 and the locking mechanism 70 locks the pipe handler 50 in position so that the pipe handling head 60, e.g. as shown in FIG. 1F, is positioned in the center of a row 12 of the fingerboard 16.

Figure 2A:
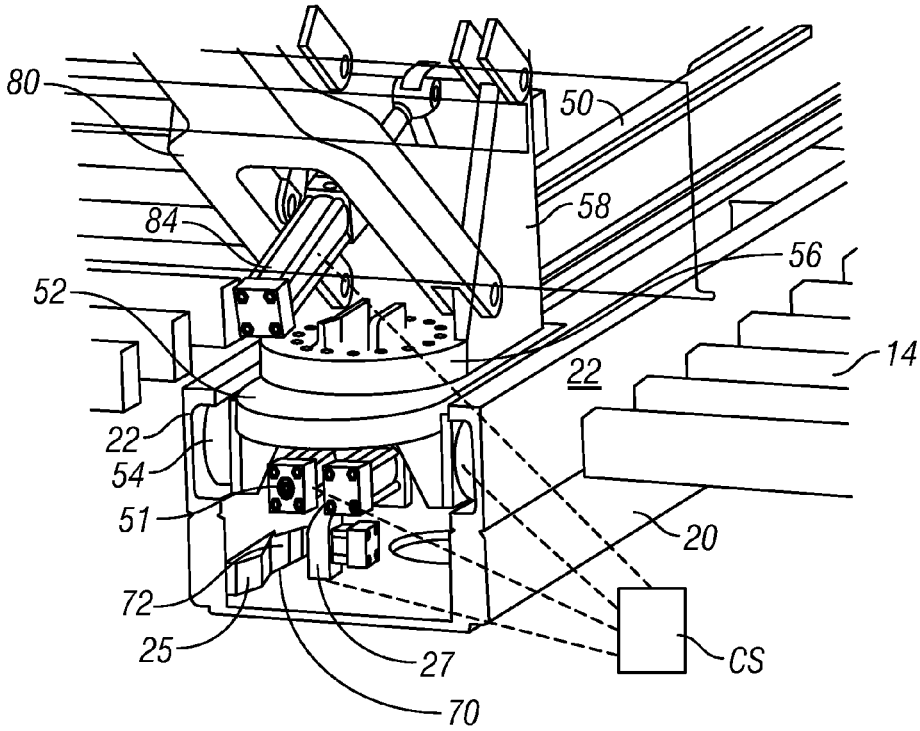
FIG. 2A is a perspective view of part of the system of FIG. 1A.
Figure 2B:
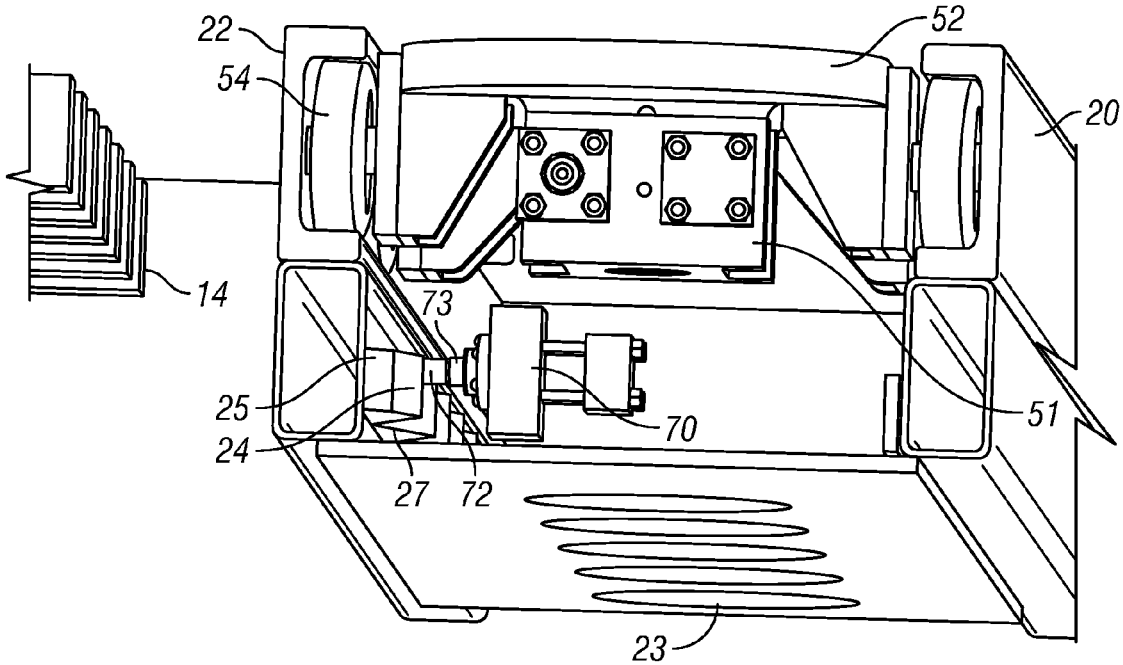
FIG. 2B is a front view of part of the system as shown in FIG. 2A.

As shown, e.g., in FIGS. 2A and 2B, the pipe handler 50 has a rotatable base 56 on the base 52. A rack-and-pinion apparatus 51 rotates the rotatable base 56 and all it supports through a full 180 degrees.

An extension mechanism 80 is pivotally mounted to a main support 58 on the base 56. The pipe handling head 60 is pivotally mounted to a distal end 82 of the extension mechanism 80. A powered cylinder apparatus 84 powers the selective extension and retraction of the extension mechanism 80.

Figure 3:
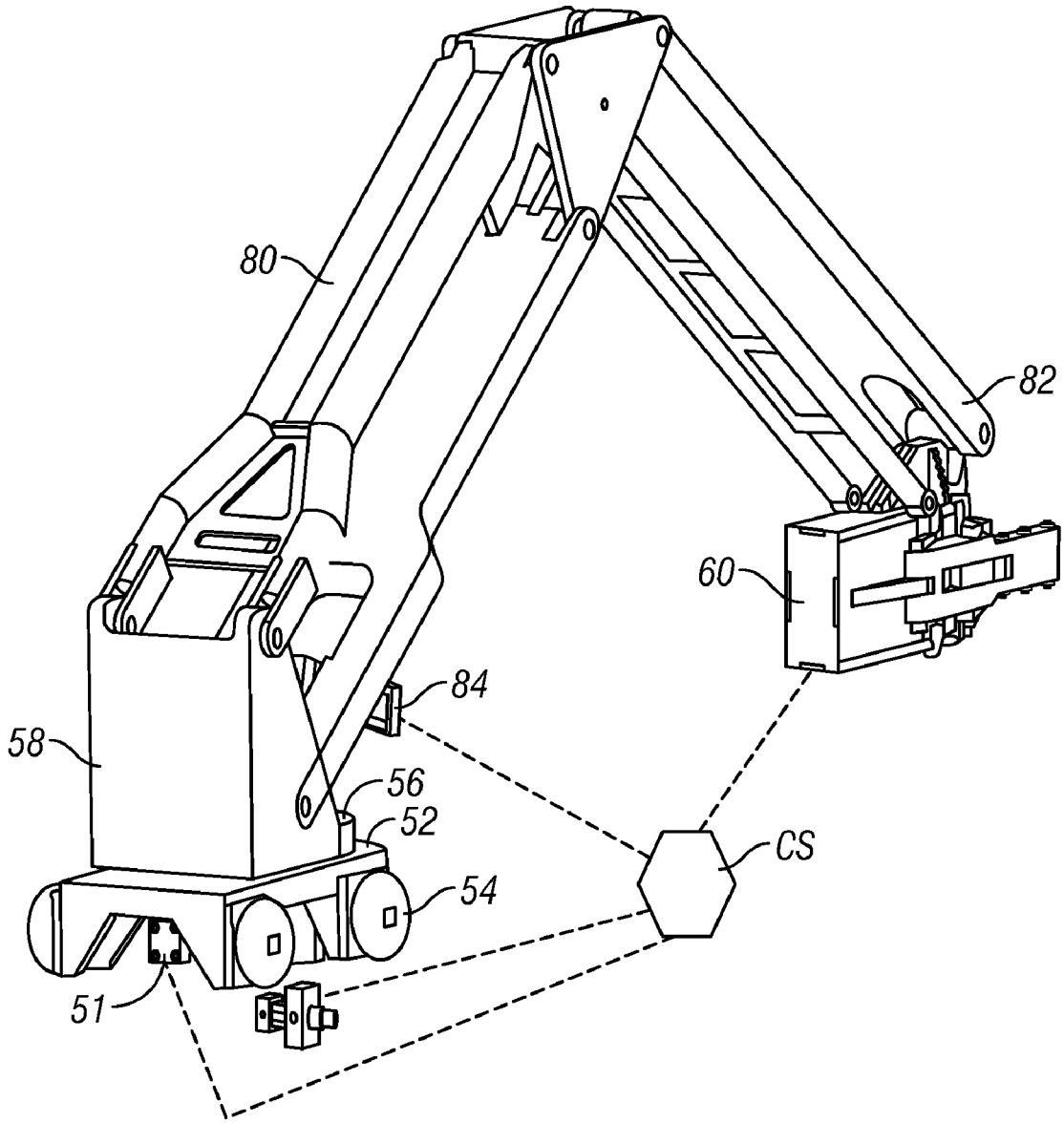
FIG. 3 is a perspective view of a pipe handler according to the present invention of the system of FIG. 1A.
Figure 4:
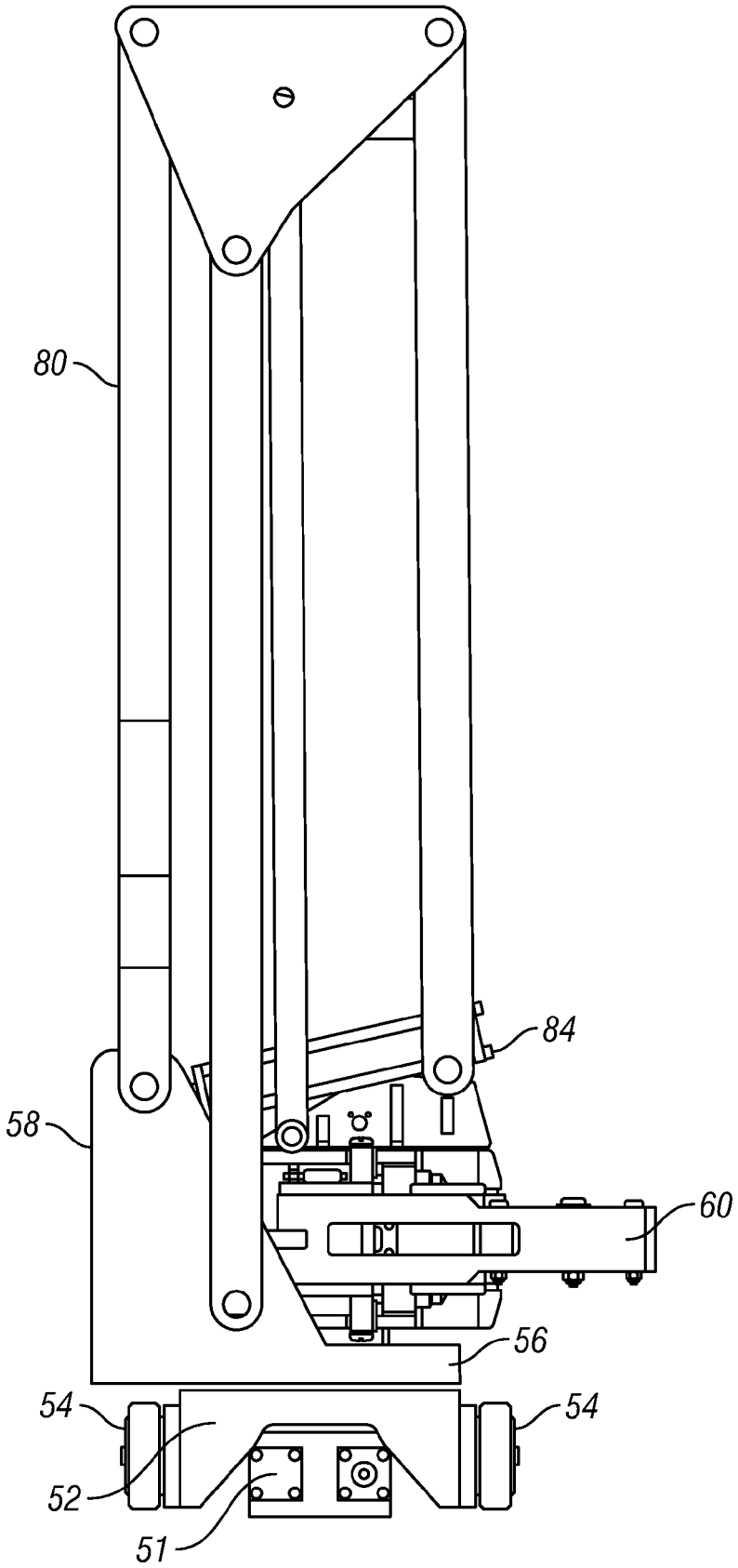
FIG. 4 is a side view of the pipe handler of FIG. 3.
Figure 5:
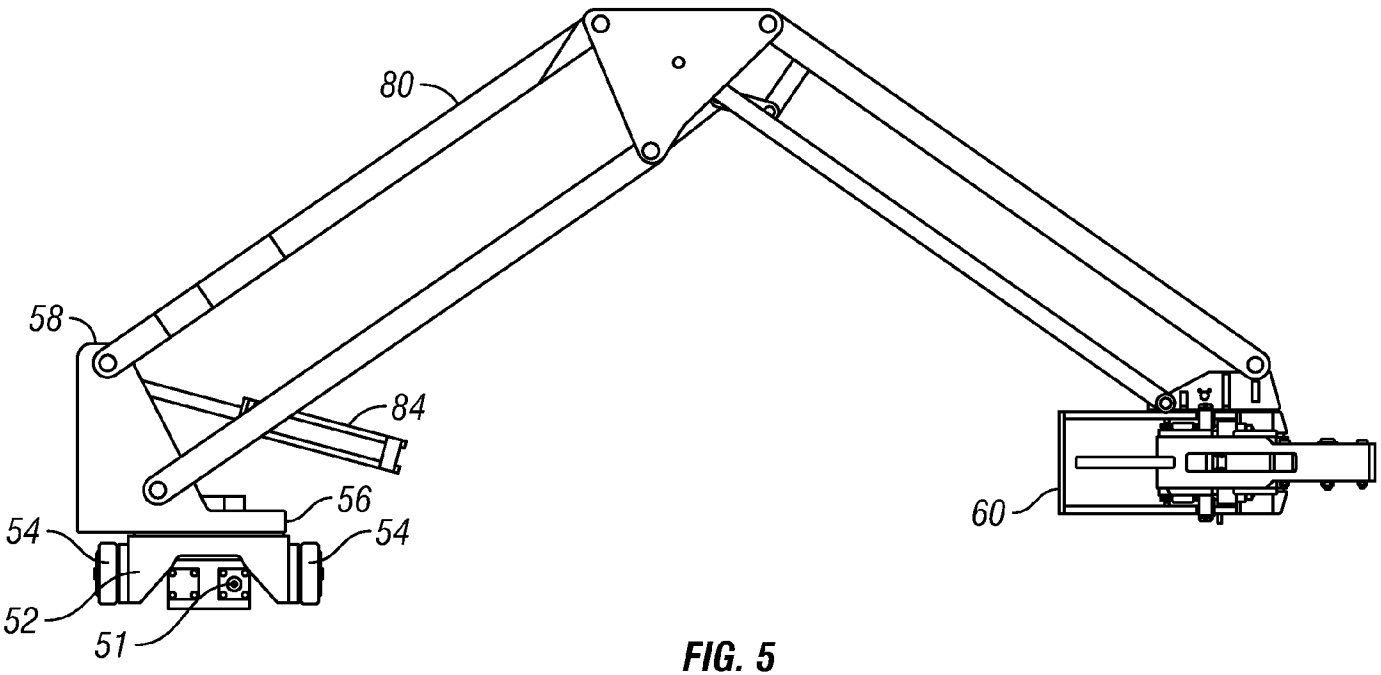
FIG. 5 is a side view of the pipe handler of FIG. 3 with the pipe handler extended.
Figure 6:
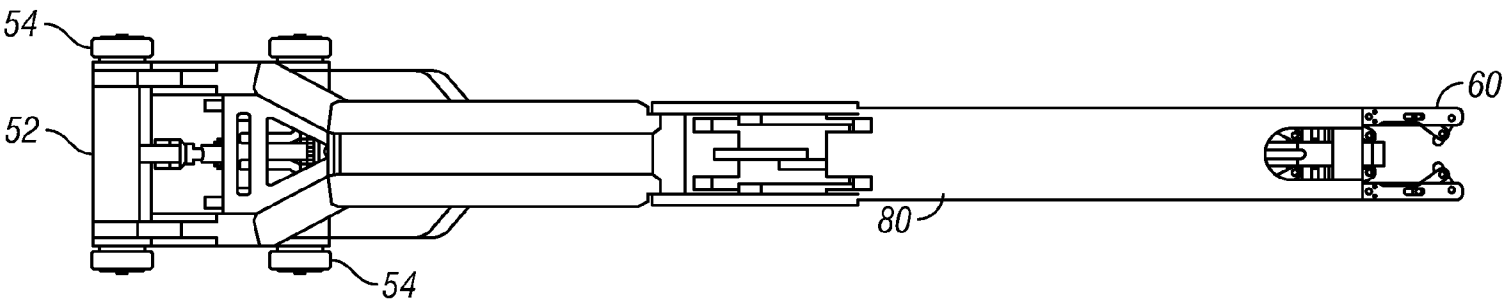
FIG. 6 is a top view of the pipe handler of FIG. 5.

A control system CS, shown schematically, FIGS. 2A and 3A, controls the pipe handler 50, the apparatus 51, the pipe handling head 60, the locking mechanism 70, and the apparatus 84. In one aspect the control system CS is located at fingerboard level and/or at drill floor level (e.g., at a driller's console) and, in one aspect, includes a camera or cameras to provide view or views of the system during operation. In one aspect a control system at fingerboard level is a manual control system. In other aspects, the control system is an electronic and/or computerized control system.

The locking mechanism 70 has a powered piston apparatus 73 with an extendable rod 72. With the rod 72 under pressure so that it is constantly forced outward (toward the lock rim 24), as the pipe handler 50 moves on the track 20, the rod 72 is thrust against the wedge members 25. The wedge shape facilitates movement of the end of the rod 72 into a point 27. With the wedge members 25 appropriately located, they line up with the fingers 14 of the fingerboard 16 (e.g., so that the desired positioning of the pipe handling head 60, discussed above, can be achieved).

As shown in FIGS. 1A, 1B, 1C and 4, the extension mechanism 80 is in a retracted configuration. As shown in FIGS. 1D, 1E, 1F, 2A, 3, 5 and 6, the extension mechanism 80 is in an extended position.

FIGS. 7A-7E shows a pipe handling head 60 according to the present invention with a body 62, movable arms 64, and movable flippers 66. Links 68 movably connect the arms 64 to the body 62 (with pins 122 through blocks 124). Links 69 pivotally connect the arms 64 to a clevis 90. A power cylinder apparatus 100, connected to the body 62 and to the clevis 90, moves the arms 64 toward and away from each other, resulting in the movement of the arms 64 toward and away from each other. Adjustability of the arms and their spacing via this structure allows one head 60 to handle different pipe sizes.

Springs 112 (shown in dotted line in FIGS. 2A, 2B) within powered cylinder apparatuses 102 provide a constant pressure on the flippers 66 biasing the flippers 66 outwardly from the head 60. The control system controls the apparatuses 102 to selectively and, as desired, move the flippers 66 e.g. to pull them in for release of a pipe. The force of a pipe entering a throat 63 between the arms 64 against the flippers 66, when the force is sufficient (the force of the head moved against the pipe), moves the flippers 66 inwardly against the force of the springs, (and at this time, force springs in the powered cylinders also forcing the flippers out) allowing the pipe to pass into the throat 63. Thus, no operator input is required to capture the pipe or stand in the throat 63. Once the pipe has passed the flippers 66 and is between the arms 64, the force applied by the apparatuses 102 moves the flippers 66 back to their initial position. Once the flippers 66 return to their original positions, they will remain there, even in the event of the loss of hydraulic power. To release the flippers, air pressure is applied to the opposite side of the piston, overcoming the spring force.

Figure 7A:
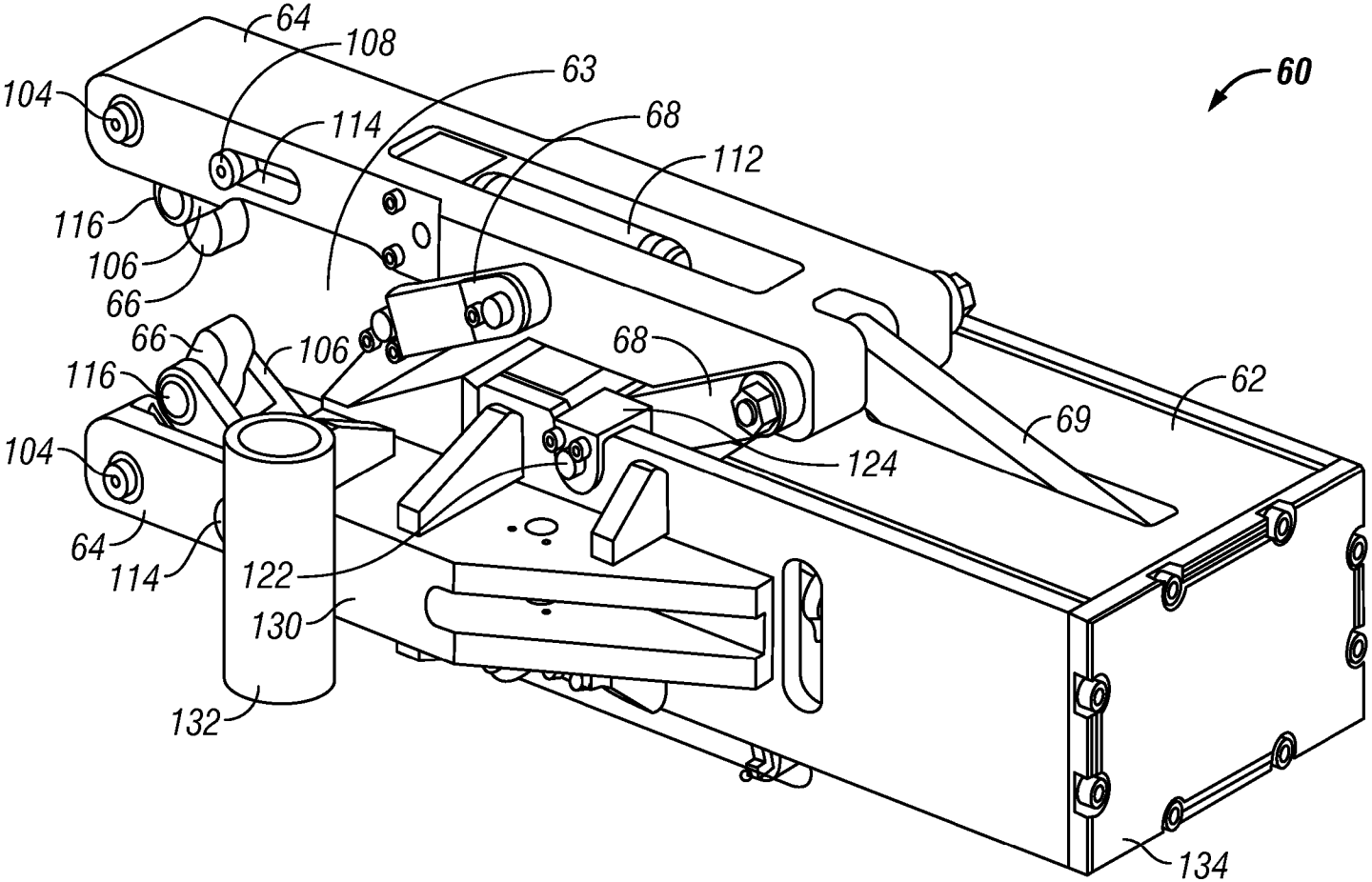
FIG. 7A is a top perspective view of a pipe handling head of the pipe handler of FIG. 5.
Figure 7B:
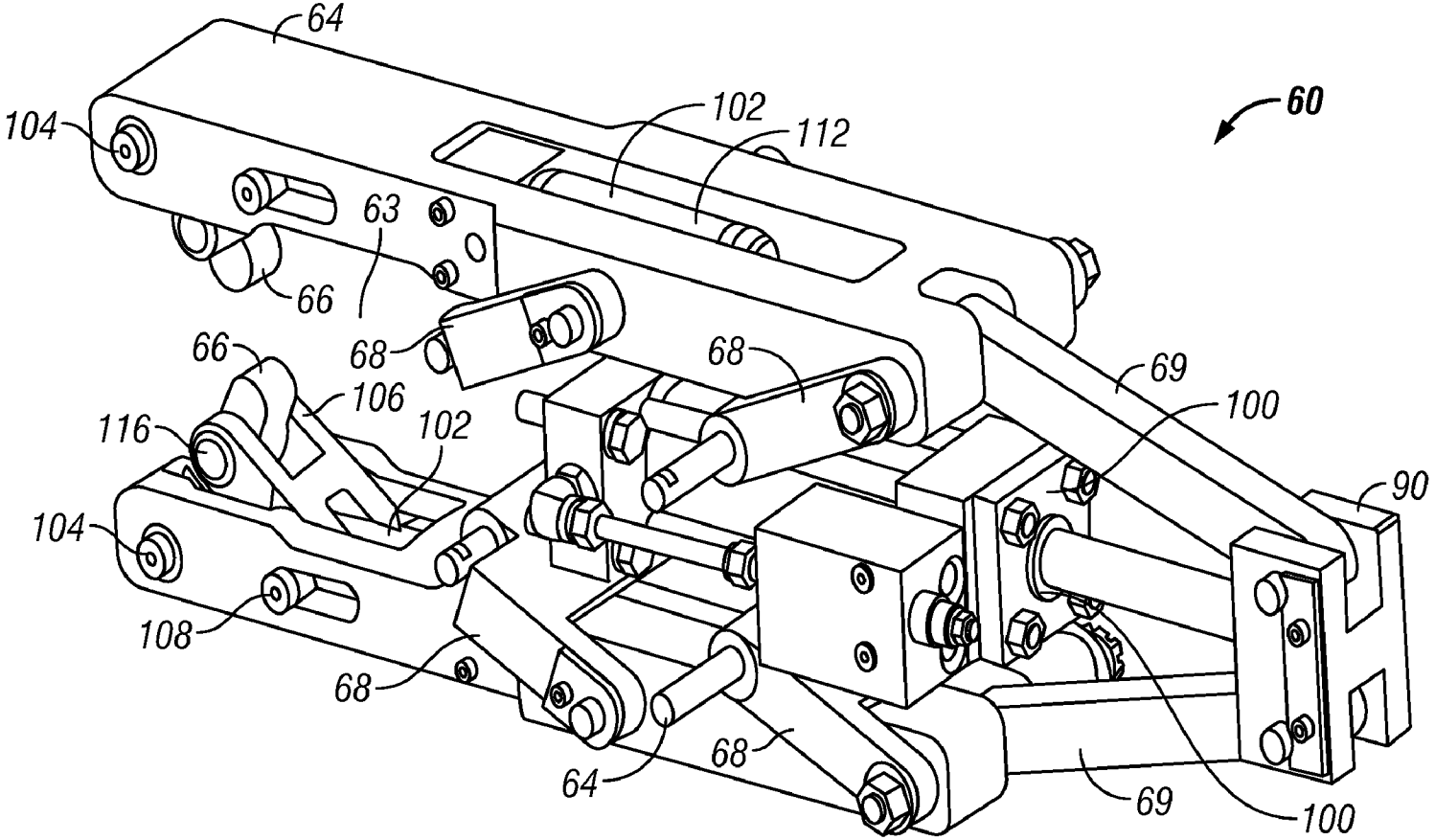
FIG. 7B is a partial perspective view of the pipe handling head of FIG. 7A.
Figure 7C:
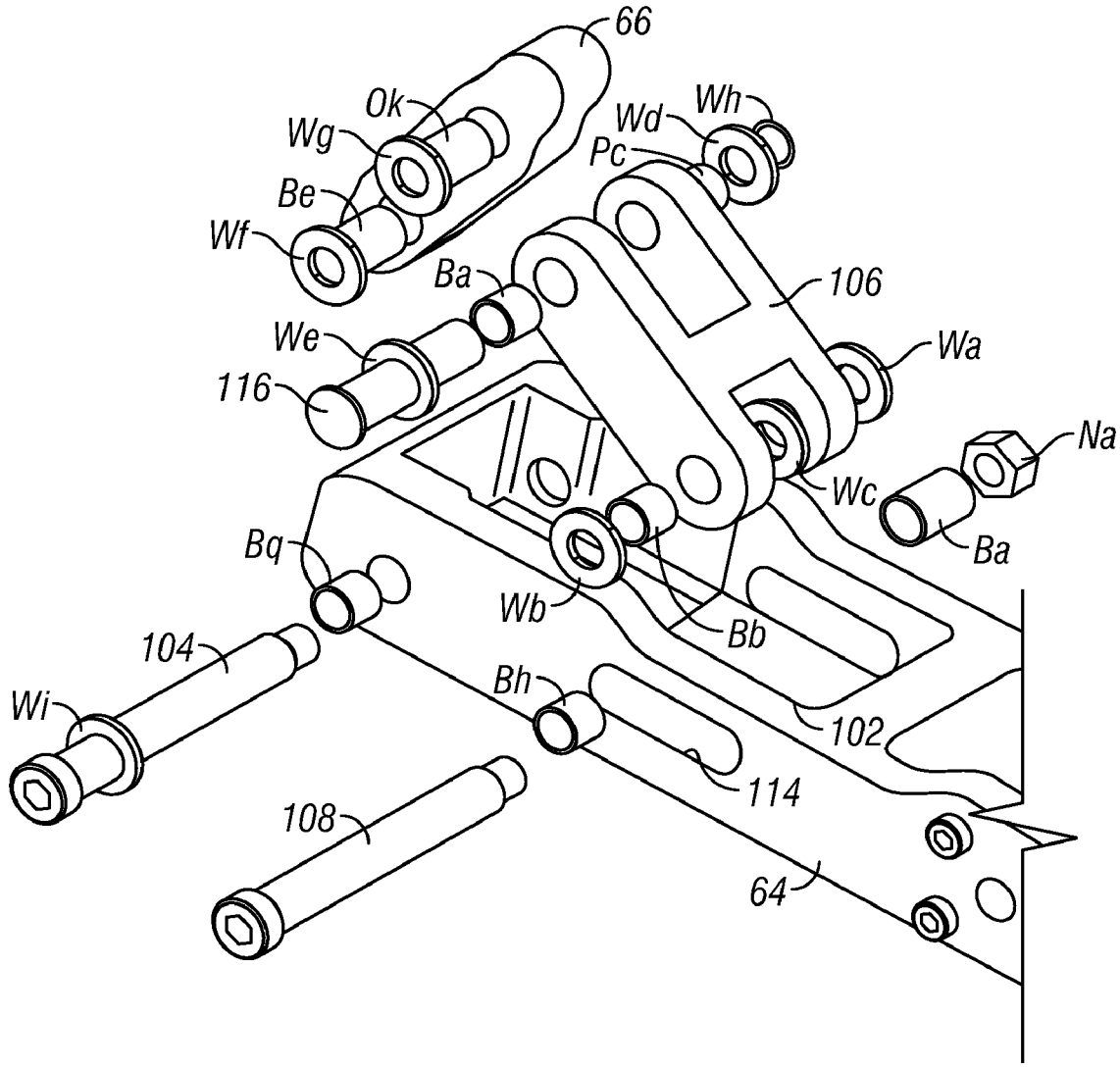
FIG. 7C is an exploded view of part of the pipe handling head of FIG. 7A.
Figure 7D:
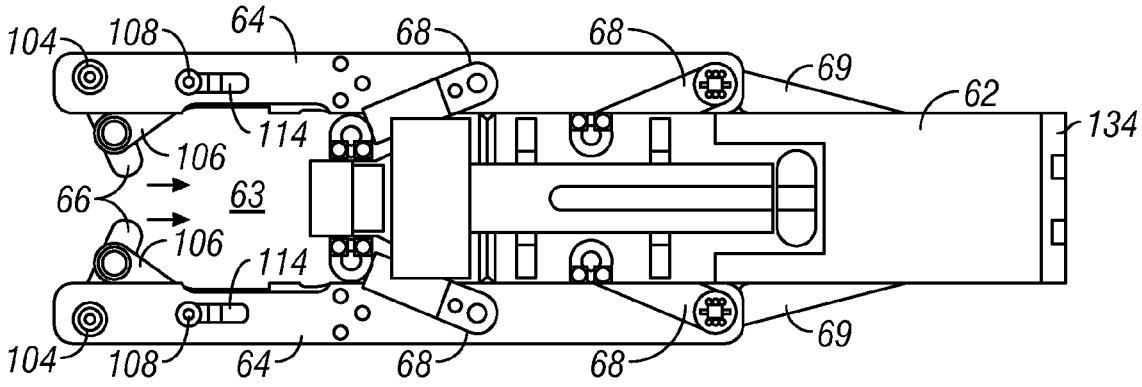
FIG. 7D is a top view of the pipe handling head of FIG. 7A.
Figure 7E:
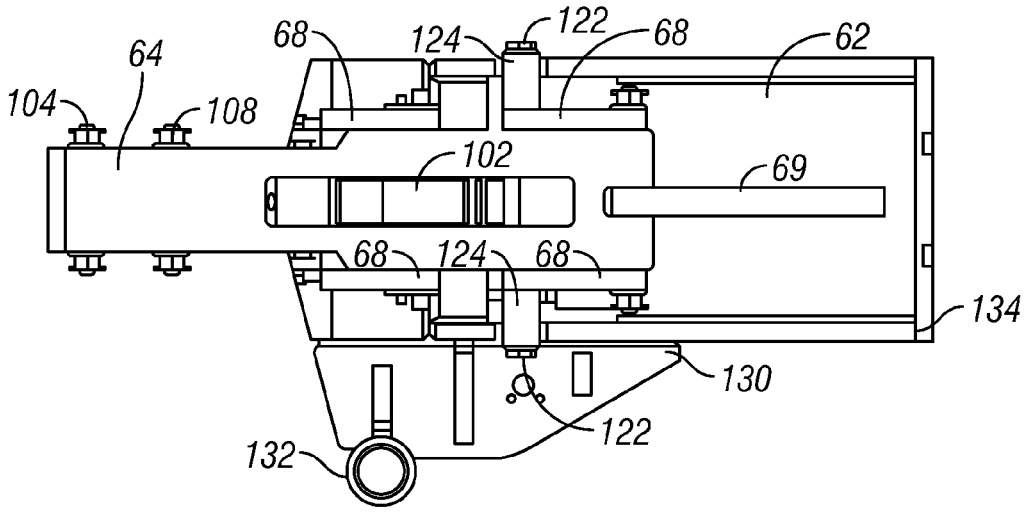
FIG. 7E is a side view of inner mechanisms of the part of FIG. 7A.

With the flippers 66 located on the arms 64 as shown in FIG. 7A, pipe or stands adjacent to a pipe or stand being captured will not contact or damage the flippers 66.

Each flipper 66 has one end pivotally connected to an arm 64 with a pin 104. A link 106 is pivotally connected at one end to the flipper 66 with a pin 116, and at the other end, with a pin 108, to the apparatus 102. The pins 108 extend into slots 114 in the arms 64 which permit movement of the flippers 66 toward the arms 64 so that a pipe larger in diameter than the initial distance between the flippers 66 can move the flippers 66 and pass between them. Appropriate washers W; nuts, N; and bushings, B are used with the various connections.

A bracket 130 connected to the body 62 has a tube 132 connected thereto which provides a connection for connecting the pipe handling head 60 to the pipe handler 50. An end plate 134 is removable secured over an end of the body 62.

The arms 64 are sized and configured so that the head does not require reversal when going between setbacks and can reach down a row with stands on either side of a fingerboard.

The flippers 66 are compliant (they move out of the way when pushed against a pipe) in the direction of arm extension, so that the force of the arms 64 is reacted by the body 62 (and the flippers move back once a pipe has passed).

Figure 11A:
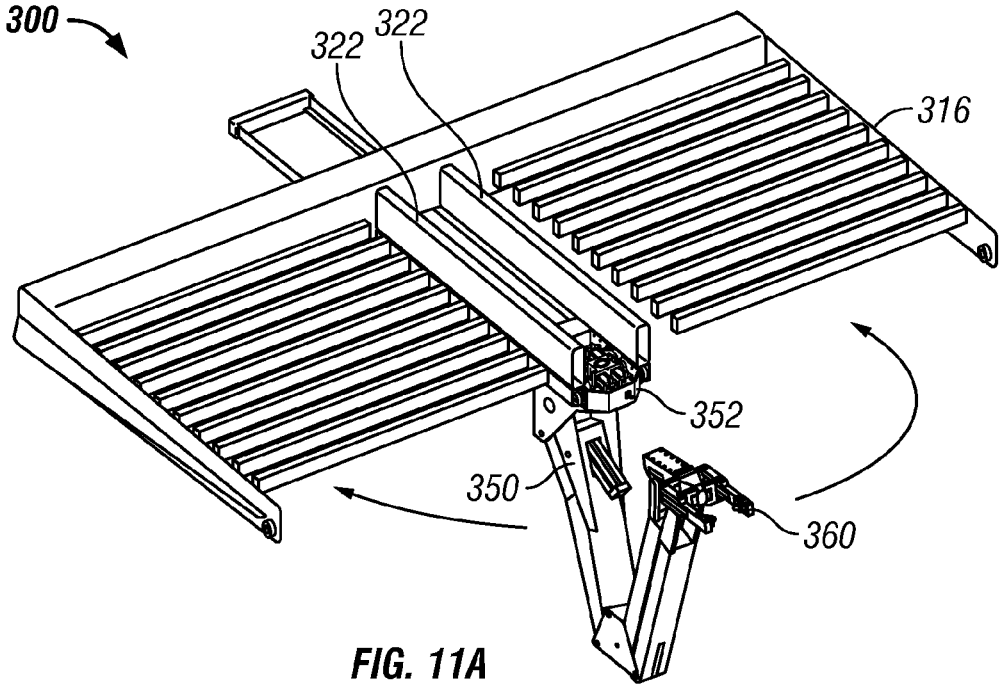
FIG. 11A is a perspective view of a pipe handling system according to the present invention.
Figure 11B:
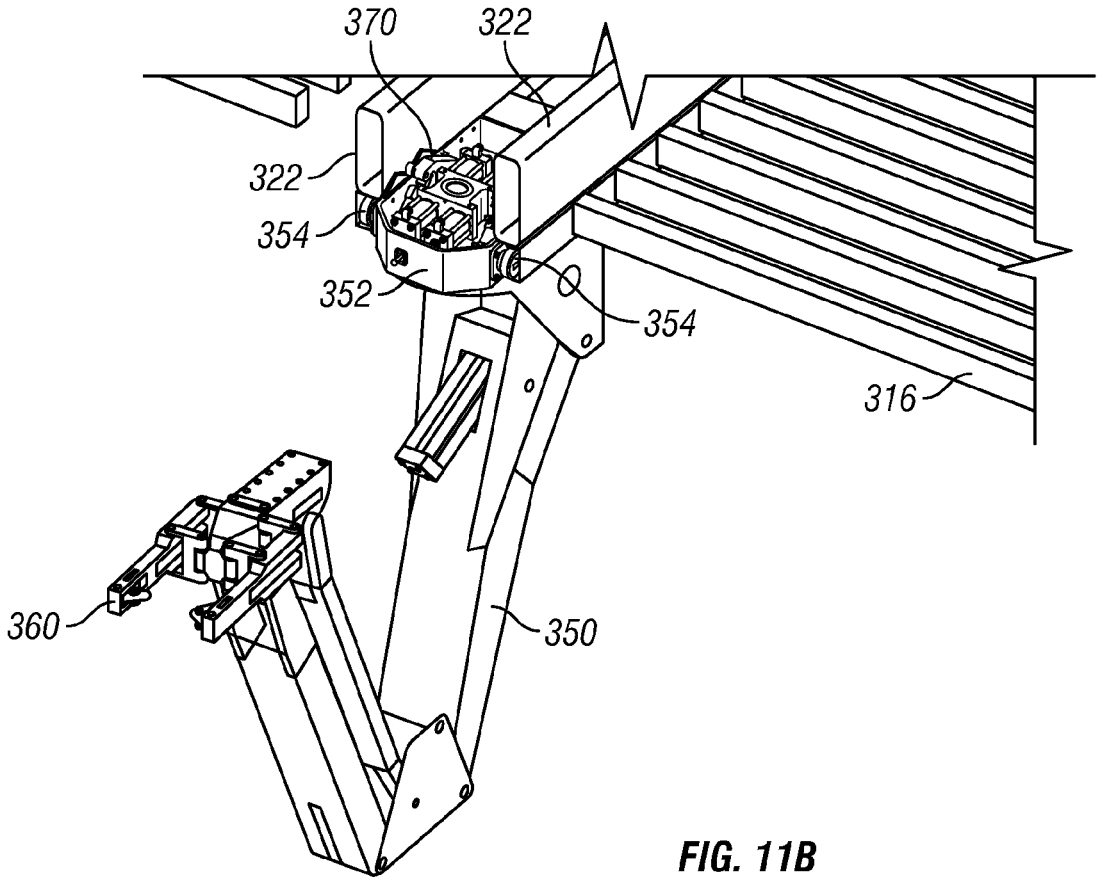
FIG. 11B is a perspective view of part of the system of FIG. 11A.
Figure 11C:
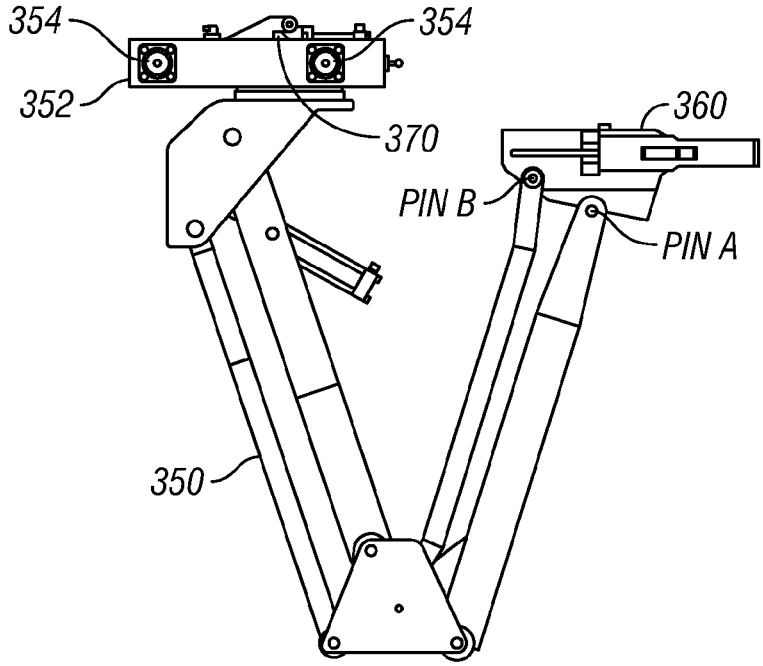
FIG. 11C is a side view of the part shown in FIG. 11B.
Figure 11D:
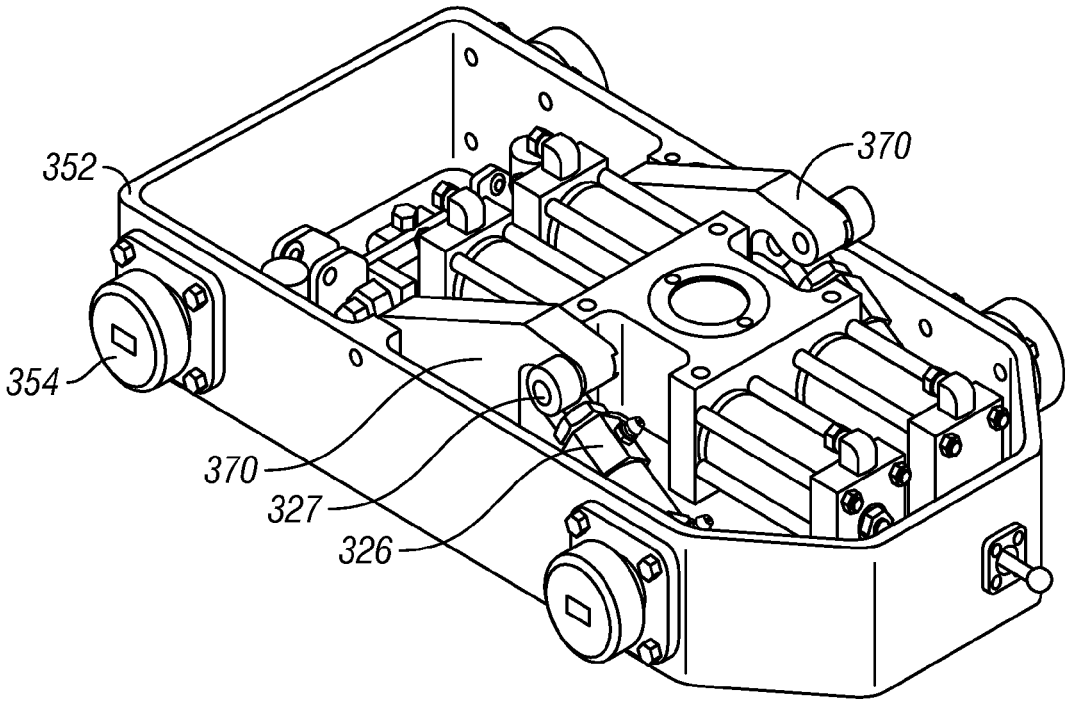
FIG. 11D is a partial perspective view of parts of the carriage of the pipe handler of the system of FIG. 11A.
Figure 11E:
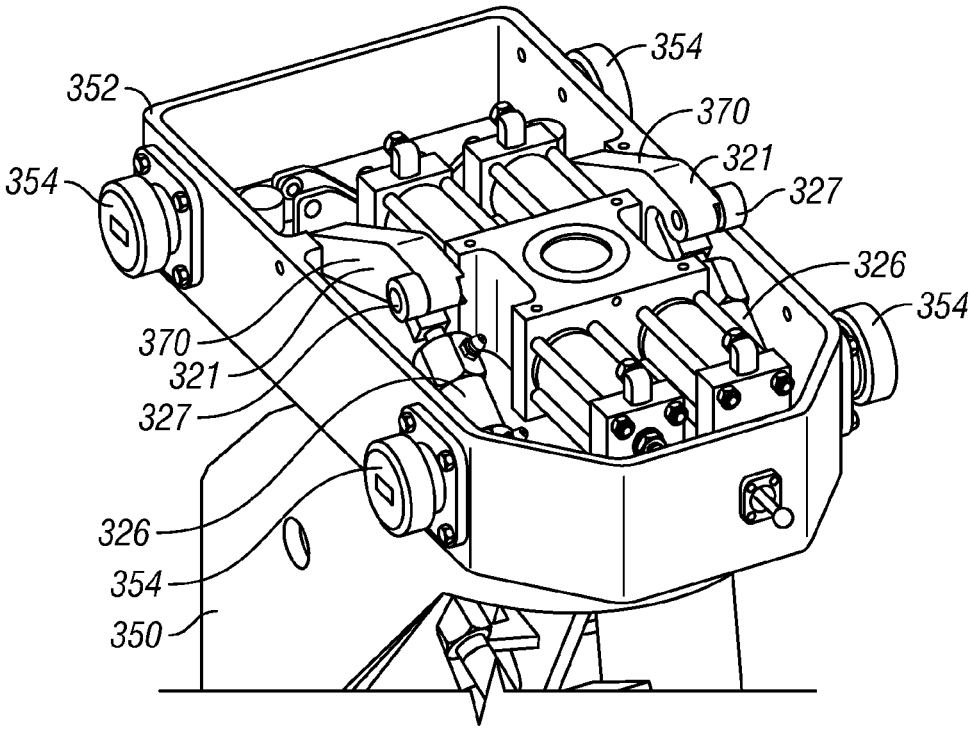
FIG. 11E is a perspective view of the parts as shown in FIG. 11D.

FIG. 11A shows a system 300 according to the present invention like the system according to the present invention shown in FIG. 1A; but in the system 300 a pipe handler 350 according to the present invention (like the pipe handler 50 in many respects) is disposed beneath a fingerboard 316 (like the fingerboard 16). The pipe handler 350 has a carriage 352 with rollers 354 that move in channels 322. Selective locking mechanisms 370 engage a lock structure 324 on the channels 322. The pipe handler 350 with a pipe handling head 360 (like the pipe handling head 60) is movable on the channels 322 so that the handling head 360 can access tubulars as does the handling head 60 (as described above). The pipe handling head 360 has a rotatable base, extension mechanism, powered cylinder apparatus, and control system(s) like those of the pipe handler 50.

Figure 11F:
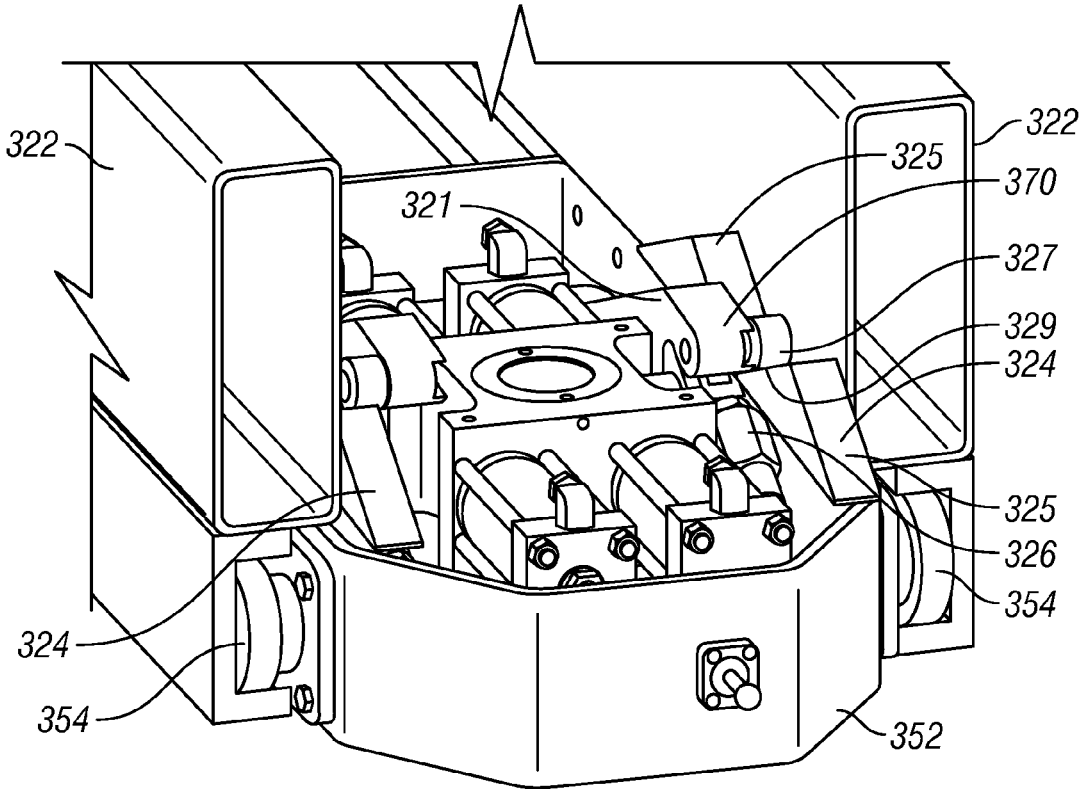
FIG. 11F is an enlargement of part of the system as shown in FIG. 11D.

The selective locking mechanisms 370 act (as does the mechanism 70 described above) to secure the carriage 352 in place so that the pipe handler 350 is located to conveniently access pipe in rows of the fingerboard 316. Although shown only partially (e.g. as in FIG. 11F) the lock structure 324 has a plurality of spaced-apart wedges 325 along the length of each channel 322. It is within the scope of the present invention to use only one locking structure 324 and only one corresponding mechanism 370.

As the carriage 325 moves on the channels 322, when the carriage 352 approaches a desired location, e.g. the system is aligned with pipe in a selected row, a powered assembly 326 (e.g. a powered piston assembly) is actuated by the control system or manually which forces a roller 327 on a movable arm 321 down into the bottom of a valley 329 between two selected wedges 325.

Optionally, the system 300 (or any system according to the present invention, e.g., the system 10) has a stop system 400 which limits slewing of the pipe handler 350 and correctly positions it in line with a well center of a rig on which the pipe handler is used, the stop system 400 also, optionally, has shock absorbing structure for controlled deceleration of the pipe handler 350 as it approaches a desired final position.

The system 400 (see FIG. 12A) has a base 403 secured to the carriage 352. Two pins 401, 402 are movably mounted to the base with mountings 401*m*, 402*m* respectively. A powered cylinder apparatus 401*c*, controlled by a control system (e.g. a controlled system CS) connected to the pin 401 via a link 401*l*, selectively moves the pin 401. A powered cylinder apparatus 402*c*, controlled by a control system (e.g. a controlled system CS) connected to the pin 402 via a link 402*l*, selectively moves the pin 402.

The pins 401, 402 are movable with respect to the carriage 352 to abut a movable plunger 405 of a shock absorber 406 (pin 401) or a plunger 407 of a shock absorber 408 (pin 402). The shock absorbers 406, 408 are secured to a base 382 of the pipe handler 350 with mounts 406*m*, 408*m*, respectively.

The shock absorbers 406, 408 are positioned so that when the pine 410 is extended, it abuts the shock absorber 406 and the pipe handler 350 stops at well center when servicing the driller side fingerboard. When the pin 402 is extended, it abuts the shock absorber 408 and the pipe handler 350 stops at well center when servicing the off driller side fingerboard.

The plungers 405, 407 move hydraulic fluid through an orifice in the shock absorbers 406, 408 to provide controlled deceleration of the pipe handler before it stops, thus protecting against impact loading.

Figure 8A:
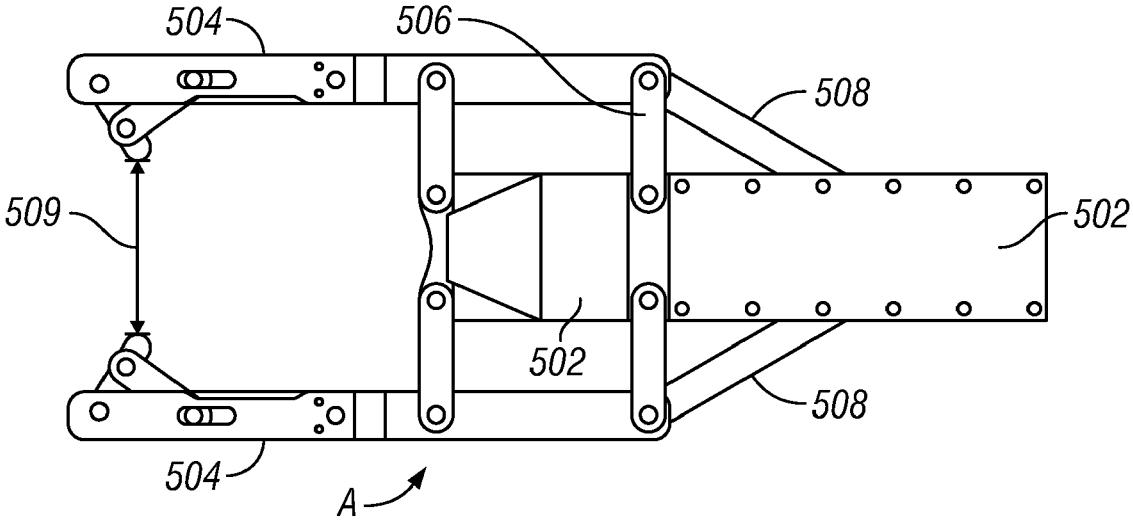
FIG. 8A is a top view of a pipe handling head according to the present invention.
Figure 8B:
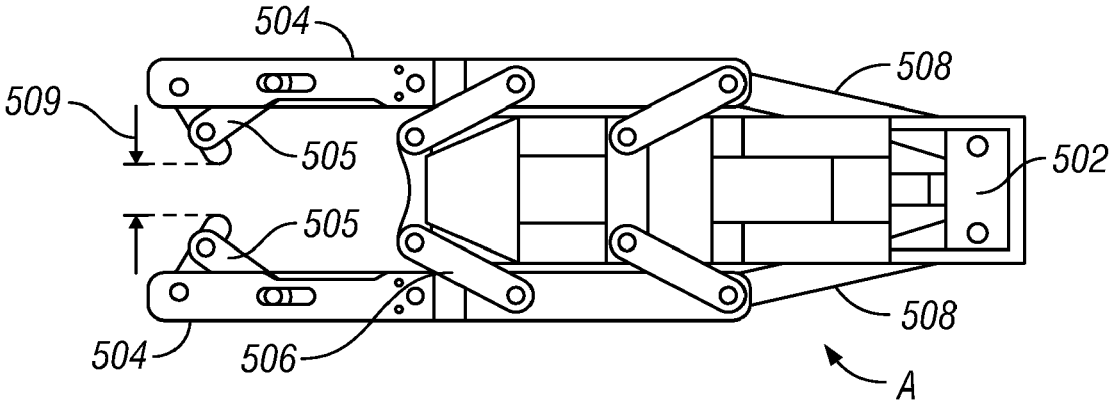
FIG. 8B is a top view of the pipe handling head of FIG. 8A.

FIGS. 8A and 8B show a pipe handling head A according to the present invention for a pipe handler according to the present invention (like the pipe handler 50) which has a body 502 with arms 504 interconnected with the body 502 by four links 506 (like the links 68) and two links 508 (like the links 69). Each arm 504 has a compliant flipper structure 505 (like the flippers 66 and their associated structure).

As shown in FIG. 8A the arms 504 are spaced-apart a maximum distance and an opening 509 is at a maximum. As shown in FIG. 8B, the arms 504 have been moved together as closely as possible. Using the four links 506 insures that the arms 504 move parallel to each other throughout their range of motion.

FIG. 8A illustrates the position of the arms 504 when the pipe handling head A is being moved into position down rows of a fingerboard between pipes in adjacent rows. FIG. 8B illustrates the position of the arms 504 when they have been moved to hold a pipe and move it.

Figure 9A:
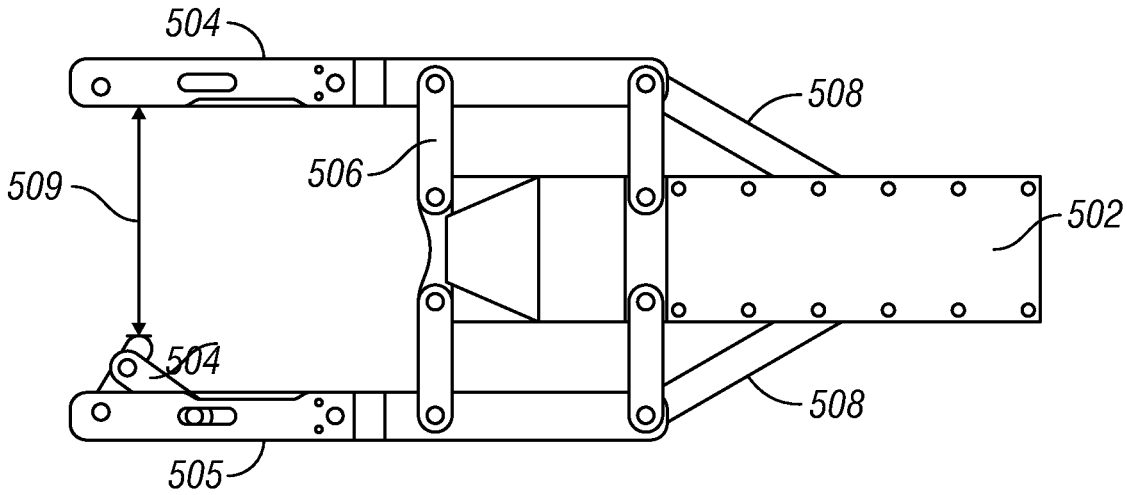
FIG. 9A is a top view of a pipe handling head according to the present invention.
Figure 9B:
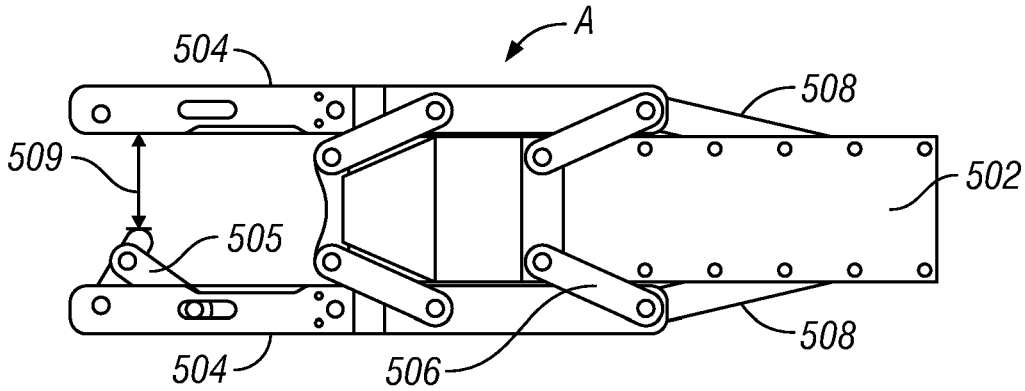
FIG. 9B is a top view of the pipe handling head of FIG. 9A.

FIG. 9A and 9B show an embodiment of the pipe handling head A in which one flipper 505 has been deleted.

Figure 10A:
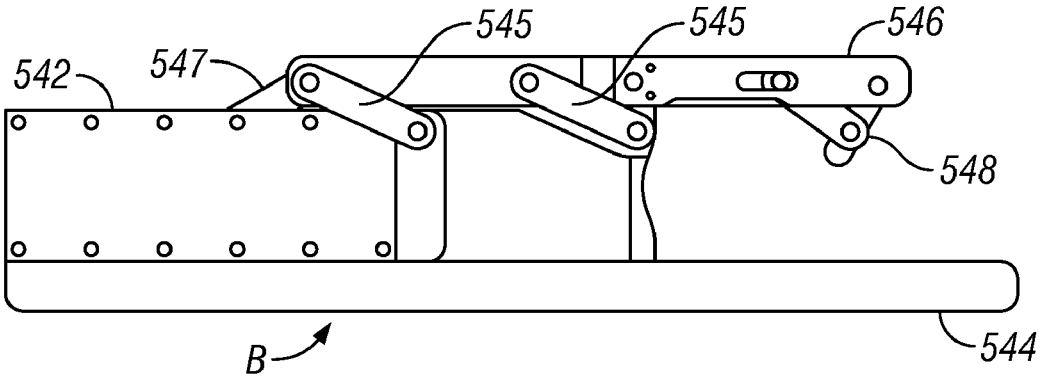
FIG. 10A is a top view of a pipe handling head according to the present invention.
Figure 10B:
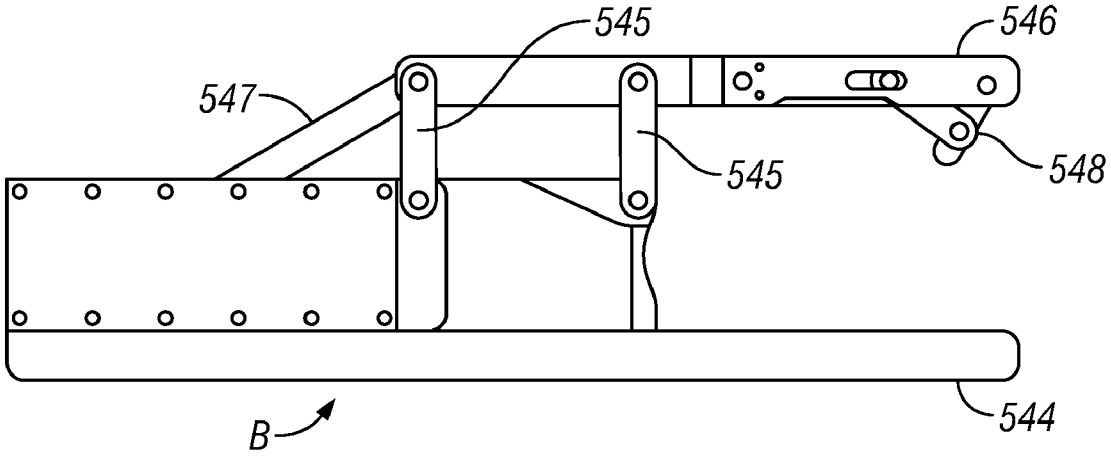
FIG. 10B is a top view of the pipe handling head of FIG. 10A.

FIGS. 10A and 10B show a pipe handling head B according to the present invention which has a body 542, an arm 544 connected to the body 542, an arm 546 connected to the body 542 via links 545 and 547, and a compliant flipper structure 548 on the arm 546. The links 545 and 547 are pivotably connected at one end to the body 542 and at the other end to the arm 546.

As shown in FIG. 10B, the arms 546 have been moved away from the arm 544 and the links 545 and 547 have pivoted with respect to the body 542.

The present invention, therefore, provides in at least some embodiments, a pipe handler for handling pipe in a fingerboard, the fingerboard having a plurality of spaced-apart fingers for supporting a plurality of pieces of pipe, the pipe handler including: a pipe handling head having a head width; a distance comprising a second width, the second width including the distance between two fingers of the finger board and twice the width of one finger; and the head width less than the second width to facilitate movement of the pipe handling head along a row between the two fingers. Such a pipe handler (and also any pipe handler according to the present invention) may have one or some (in any possible combination) of the following: extension apparatus for moving the pipe handling head, the extension apparatus having a first end and a second end, carriage apparatus, the first end of the extension apparatus connected to the pipe handling head, the second end of the extension apparatus connected to the carriage apparatus, and track structure, the carriage apparatus movable on the track structure so that the pipe handling head can access pipe on the fingerboard; locking apparatus for selectively locking the carriage apparatus in place on the track structure; the locking apparatus having a plurality of spaced-apart wedge members on the track with a plurality of lowermost areas, one of said lowermost areas between each pair of wedge members, and powered piston apparatus on the carriage with an extendable rod for receipt in a lowermost area to lock the carriage in place on the track; the pipe handling head having at least one movable arm movable with respect to a pipe on the fingerboard to facilitate engagement of the pipe by the pipe handling head; the at least one moveable arm is two opposed movable arms; at least one flipper movably connected to the at least one movable arm, the at least one flipper projecting inwardly of the at least one movable arm, the at least one flipper constantly biased inwardly with respect to the at least one movable arm, and the at least one flipper for maintenance of a pipe in position in the pipe handling head; the at least one moveable arm is two opposed movable arms, the at least one flipper includes a flipper movably connected to each arm, and the flippers biased toward each other; wherein the pipe handling head has a body and the arms are connected to the body for parallel movement with respect to each other; wherein the carriage is movable above the track; wherein the carriage is movable below the track; a base, rotation apparatus rotationally mounted on the base, and the extension apparatus connected to the rotation apparatus; stop apparatus for limiting movement of the pipe handler and for positioning the pipe handler in a desired position with respect to a well center; and/or wherein the stop apparatus includes shock absorbing apparatus for controlled deceleration of the pipe handling head as the pipe handling head approaches a stop point.

The present invention, therefore, provides in at least some embodiments, a pipe handler for handling pipe in a fingerboard, the fingerboard having a plurality of spaced-apart fingers for supporting a plurality of pieces of pipe, the pipe handler including: a pipe handling head having at least one movable arm movable with respect to a pipe on a fingerboard to facilitate engagement of the pipe by the pipe handling head; at least one flipper movably connected to the at least one movable arm; the at least one flipper projecting inwardly of the at least one movable arm; the at least one flipper constantly biased inwardly with respect to the at least one movable arm; and the at least one flipper for maintenance of a pipe in position in the pipe handling head.

What is claimed is:

1. A pipe handler for handling pipe in a fingerboard, the fingerboard having a plurality of spaced-apart fingers for supporting a plurality of pieces of pipe and a plurality of rows, each row positioned between each pair of adjacent fingers, the pipe handler comprising:

a pipe handling head;

an extension apparatus for moving the pipe handling head, the extension apparatus having a first end and a second end;

a carriage apparatus;

wherein the first end of the extension apparatus connected to the pipe handling head, the second end of the extension apparatus connected to the carriage apparatus; and a track structure, the carriage apparatus movably disposed on the track structure so that the pipe handling head can access pipe on the fingerboard;

a locking apparatus for selectively locking the carriage apparatus in place on the track structure;

wherein the locking apparatus includes:

a lock structure extending along the track, wherein the lock structure includes a plurality of v-shaped wedges and a plurality of v-shaped recesses, each recess being disposed between a pair of adjacent wedges;

wherein each wedge has a first guide surface and a second guide surface;

wherein each recess is defined by the first guide surface of one wedge and the second guide surface of the adjacent wedge;

wherein each recess includes a point at an intersection of the first guide surface of one wedge and the second guide surface of an adjacent wedge;

a locking member moveably coupled to the carriage and configured to be urged into engagement with one of the v-shaped recesses to lock the carriage in place on the track and align the pipe handling head with one of the rows;

wherein the first guide surfaces and the second guides surface are configured to guide the locking member toward the points.

2. The pipe handler of claim 1, wherein the pipe handling head has at least one movable arm movable with respect to a pipe on the fingerboard to facilitate engagement of the pipe by the pipe handling head.

3. The pipe handler of claim 2 wherein the at least one moveable arm is two opposed movable arms.

4. The pipe handler of claim 2 further comprising:

at least one flipper movably connected to the at least one movable arm;

the at least one flipper projecting inwardly of the at least one movable arm;

the at least one flipper constantly biased inwardly with respect to the at least one movable arm; and the at least one flipper for maintenance of a pipe in position in the pipe handling head.

5. The pipe handler of claim 4 wherein the at least one moveable arm is two opposed movable arms, the at least one flipper includes a flipper movably connected to each arm, and the flippers biased toward each other.

6. The pipe handler of claim 5 wherein the pipe handling head has a body and the arms are connected to the body for parallel movement with respect to each other.

7. The pipe handler of claim 1 wherein the carriage is movable below the track.

8. The pipe handler of claim 1 further comprising:

a base;

rotation apparatus rotationally mounted on the base; and the extension apparatus connected to the rotation apparatus.

9. The pipe handler of claim 8 further comprising:

stop apparatus for limiting movement of the pipe handler and for positioning the pipe handler in a desired position with respect to a well center.

10. The pipe handler of claim 9 wherein the stop apparatus includes shock absorbing apparatus for controlled deceleration of the pipe handling head as the pipe handling head approaches a stop point.

11. The pipe handler of claim 1, wherein the pipe handling head has a head width;

wherein each row of the fingerboard has a first width;

wherein each finger of the fingerboard has a second width;

wherein the head width is less than the first width plus twice the second width.

12. The pipe handler of claim 1, further comprising a powered piston apparatus on the carriage configured to bias the extendable rod outwardly and into engagement with one of the recessed points.

13. The pipe handler of claim 1 wherein the carriage is movable above the track.

14. A pipe handler for handling pipe in a fingerboard, the fingerboard having a plurality of spaced-apart fingers for supporting a plurality of pieces of pipe, the pipe handler comprising:

a pipe handling head;

an extension apparatus having a first end and a second end;

a carriage apparatus;

the first end of the extension apparatus connected to the pipe handling head, the second end of the extension apparatus connected to the carriage apparatus;

a track structure, the carriage apparatus movable on the track structure so that the pipe handling head can access pipe on the fingerboard;

the pipe handling head having at least one movable arm movable with respect to a pipe on the fingerboard to facilitate engagement of the pipe by the pipe handling head;

at least one flipper movably connected to the at least one movable arm;

the at least one flipper projecting inwardly of the at least one movable arm;

the at least one flipper constantly biased inwardly with respect to the at least one movable arm; and the at least one flipper for maintenance of a pipe in position in the pipe handling head;

a locking apparatus including:

a lock structure extending along the track, wherein the lock structure includes a plurality of v-shaped wedges and a plurality of v-shaped recesses, each recess being disposed between a pair of adjacent wedges;

wherein each wedge has a first guide surface and a second guide surface;

wherein each recess is defined by the first guide surface of one wedge and the second guide surface of the adjacent wedge;

wherein each recess includes a point at an intersection of the first guide surface of one wedge and the second guide surface of an adjacent wedge;

a locking member moveably coupled to the carriage and configured to be urged into engagement with one of the v-shaped recesses to lock the carriage in place on the track and align the pipe handling head with one of the rows;

wherein the first guide surfaces and the second guide surfaces are configured to guide the locking member toward the points.

15. The pipe handler of claim 14 wherein the at least one moveable arm is two opposed movable arms;

wherein the at least one moveable arm is two opposed movable arms;

the at least one flipper includes two flippers, including a flipper movably connected to each arm; and the flippers constantly biased toward each other.

16. The pipe handler of claim 14 further comprising:

a base;

rotation apparatus rotationally mounted on the base; and the extension apparatus connected to the rotation apparatus;

stop apparatus for limiting movement of the pipe handler and for positioning the pipe handler in a desired position with respect to a well center;

the stop apparatus including shock absorbing apparatus for controlled deceleration of the rotation apparatus as the pipe handling head approaches a stop point;

the pipe handling head having a body and the arms connected to the body for parallel movement with respect to each other;

the pipe handling head having a head width, a distance comprising a second width, the second width including the distance between two fingers of the finger board and twice the width of one finger; and the head width less than the second width to facilitate movement of the pipe handling head along a row between the two fingers.

* * * * *